US008607899B2

(12) United States Patent
Vo et al.

(10) Patent No.: US 8,607,899 B2
(45) Date of Patent: Dec. 17, 2013

(54) ROCK BIT AND CUTTER TEETH GEOMETRIES

(75) Inventors: Thang Vo, Houston, TX (US); Tom Scott Roberts, Magnolia, TX (US); Adrian Reyes, Pearland, TX (US); Robert Morton, San Francisco, CA (US)

(73) Assignee: National Oilwell Varco, L.P., Houston, TX (US)

( * ) Notice: Subject to any disclaimer, the term of this patent is extended or adjusted under 35 U.S.C. 154(b) by 352 days.

(21) Appl. No.: 13/030,513

(22) Filed: Feb. 18, 2011

(65) Prior Publication Data

US 2012/0211282 A1 Aug. 23, 2012

(51) Int. Cl.
*E21B 10/16* (2006.01)

(52) U.S. Cl.
CPC ..... *E21B 10/16* (2013.01)
USPC ..... 175/374; 175/430; 175/341

(58) Field of Classification Search
USPC ..... 175/430, 374, 331, 378, 341
See application file for complete search history.

(56) References Cited

U.S. PATENT DOCUMENTS

| | | | | |
|---|---|---|---|---|
| 2,578,593 | A | 12/1951 | Phipps | |
| 3,388,757 | A * | 6/1968 | Fittinger | 175/426 |
| 3,442,342 | A | 5/1969 | McElya et al. | |
| 3,946,820 | A * | 3/1976 | Knapp | 175/341 |
| 4,056,153 | A | 11/1977 | Miglierini | |
| 4,058,177 | A | 11/1977 | Langford, Jr. et al. | |
| 4,086,973 | A | 5/1978 | Keller et al. | |
| 4,108,260 | A | 8/1978 | Bozarth | |
| 4,254,840 | A | 3/1981 | Shay, Jr. | |
| 4,334,586 | A | 6/1982 | Schumacher | |
| 4,352,400 | A | 10/1982 | Grappendorf et al. | |
| 4,368,788 | A | 1/1983 | Drake | |
| 4,372,404 | A | 2/1983 | Drake | |
| 4,398,952 | A | 8/1983 | Drake | |
| 4,511,006 | A | 4/1985 | Grainger | |

(Continued)

FOREIGN PATENT DOCUMENTS

| | | |
|---|---|---|
| EP | 0391683 A1 | 10/1990 |
| EP | 0446765 A1 | 9/1991 |

(Continued)

OTHER PUBLICATIONS

Dekun, Ma, Translated by Ma Dekun and Jiao Peilin, The Operational Mechanics of the Rock Bit, (Petroleum Industry Press, 1996) (China) (6 pages).

*Primary Examiner* — Cathleen Hutchins
(74) *Attorney, Agent, or Firm* — Conley Rose, P.C.

(57) ABSTRACT

A rolling cone drill bit for cutting a borehole comprises a rolling cone cutter mounted on a bit body and adapted for rotation about a cone axis. Further, the bit comprises a tooth extending from the cone cutter. The tooth includes a base at the cone cutter and an elongate chisel crest distal the cone cutter. The crest extends along a crest median line between a first crest end and a second crest end and includes an elongate crest apex. The tooth also includes a first flanking surface extending from the base to the crest, and a second flanking surface extending from the base to the crest. The first flanking surface and the second flanking surface taper towards one another to form the chisel crest. Moreover, the tooth includes a first raised rib extending continuously along the first flanking surfaces and across the chisel crest to the second flanking surface.

17 Claims, 22 Drawing Sheets

(56) References Cited

U.S. PATENT DOCUMENTS

| | | | | |
|---|---|---|---|---|
| 4,554,130 | A | | 11/1985 | Ecer |
| 4,562,892 | A | | 1/1986 | Ecer |
| 4,586,574 | A | | 5/1986 | Grappendorf |
| 4,592,252 | A | | 6/1986 | Ecer |
| 4,597,456 | A | | 7/1986 | Ecer |
| 4,630,692 | A | | 12/1986 | Ecer |
| 4,716,977 | A | | 1/1988 | Huffstutler |
| 4,722,405 | A | | 2/1988 | Langford, Jr. |
| 4,811,801 | A | | 3/1989 | Salesky et al. |
| 4,832,139 | A | | 5/1989 | Minikus et al. |
| 4,853,178 | A | | 8/1989 | Oslin |
| 4,854,405 | A | | 8/1989 | Stroud |
| 4,933,140 | A | | 6/1990 | Oslin |
| 4,949,598 | A | | 8/1990 | Griffin |
| 4,951,762 | A | | 8/1990 | Lundell |
| 5,032,352 | A | | 7/1991 | Meeks et al. |
| D324,527 | S | | 3/1992 | Slutz |
| 5,131,478 | A | | 7/1992 | Brett et al. |
| 5,172,777 | A | | 12/1992 | Siracki et al. |
| 5,172,779 | A | | 12/1992 | Siracki et al. |
| 5,197,555 | A | | 3/1993 | Estes |
| 5,201,376 | A | * | 4/1993 | Williams ..... 175/374 |
| 5,303,787 | A | | 4/1994 | Brady |
| 5,322,138 | A | | 6/1994 | Siracki |
| 5,323,865 | A | | 6/1994 | Isbell et al. |
| 5,341,890 | A | | 8/1994 | Cawthorne et al. |
| 5,351,768 | A | | 10/1994 | Scott et al. |
| 5,372,210 | A | | 12/1994 | Harrell |
| 5,379,854 | A | | 1/1995 | Dennis |
| 5,407,022 | A | | 4/1995 | Scott et al. |
| 5,421,423 | A | | 6/1995 | Huffstutler |
| 5,421,424 | A | | 6/1995 | Portwood et al. |
| 5,429,199 | A | | 7/1995 | Sheirer et al. |
| 5,429,200 | A | | 7/1995 | Blackman et al. |
| 5,452,771 | A | | 9/1995 | Blackman et al. |
| 5,479,997 | A | | 1/1996 | Scott et al. |
| 5,518,077 | A | | 5/1996 | Blackman et al. |
| 5,533,582 | A | | 7/1996 | Tibbitts |
| 5,535,839 | A | | 7/1996 | Brady |
| 5,542,485 | A | | 8/1996 | Pessier et al. |
| 5,560,440 | A | | 10/1996 | Tibbitts |
| 5,592,995 | A | | 1/1997 | Scott et al. |
| 5,636,700 | A | | 6/1997 | Shamburger, Jr. |
| 5,644,956 | A | | 7/1997 | Blackman et al. |
| 5,653,299 | A | | 8/1997 | Sreshta et al. |
| 5,676,214 | A | | 10/1997 | Pearce et al. |
| 5,695,019 | A | | 12/1997 | Shamburger, Jr. |
| 5,697,462 | A | | 12/1997 | Grimes et al. |
| 5,709,278 | A | | 1/1998 | Crawford |
| 5,743,346 | A | | 4/1998 | Flood et al. |
| 5,746,280 | A | | 5/1998 | Scott et al. |
| 5,752,573 | A | | 5/1998 | Scott et al. |
| 5,755,301 | A | | 5/1998 | Love et al. |
| 5,813,485 | A | | 9/1998 | Portwood |
| 5,819,861 | A | | 10/1998 | Scott et al. |
| 5,833,020 | A | | 11/1998 | Portwood et al. |
| 5,839,526 | A | | 11/1998 | Cisneros et al. |
| 5,871,606 | A | | 2/1999 | Sakamoto et al. |
| 5,874,060 | A | | 2/1999 | Armour et al. |
| 5,881,828 | A | | 3/1999 | Fischer et al. |
| 5,887,655 | A | | 3/1999 | Haugen et al. |
| 5,887,668 | A | | 3/1999 | Haugen et al. |
| 5,890,550 | A | | 4/1999 | Swadi et al. |
| 5,915,486 | A | | 6/1999 | Portwood et al. |
| 5,950,745 | A | | 9/1999 | Ingmarsson |
| 5,967,245 | A | | 10/1999 | Garcia et al. |
| 5,967,248 | A | | 10/1999 | Drake et al. |
| 6,029,759 | A | | 2/2000 | Sue et al. |
| 6,045,750 | A | | 4/2000 | Drake et al. |
| 6,053,263 | A | | 4/2000 | Meiners |
| 6,059,054 | A | | 5/2000 | Portwood et al. |
| 6,060,016 | A | | 5/2000 | Vuyk, Jr. et al. |
| 6,105,693 | A | | 8/2000 | Ingmarsson |
| 6,105,694 | A | | 8/2000 | Scott |
| D430,578 | S | | 9/2000 | Brady |
| 6,135,218 | A | | 10/2000 | Deane et al. |
| 6,161,634 | A | | 12/2000 | Minikus et al. |
| 6,176,332 | B1 | | 1/2001 | Massa et al. |
| 6,176,333 | B1 | | 1/2001 | Doster |
| 6,196,340 | B1 | | 3/2001 | Jensen et al. |
| 6,199,645 | B1 | | 3/2001 | Anderson et al. |
| 6,202,752 | B1 | | 3/2001 | Kuck et al. |
| 6,241,034 | B1 | | 6/2001 | Steinke et al. |
| 6,241,035 | B1 | | 6/2001 | Portwood |
| 6,290,008 | B1 | | 9/2001 | Portwood et al. |
| 6,338,621 | B1 | | 1/2002 | Vuyk, Jr. et al. |
| 6,347,676 | B1 | | 2/2002 | Vuyk, Jr. |
| 6,367,568 | B2 | | 4/2002 | Steinke et al. |
| 6,510,910 | B2 | | 1/2003 | Eyre et al. |
| 6,530,441 | B1 | | 3/2003 | Singh et al. |
| 6,561,293 | B2 | | 5/2003 | Minikus et al. |
| 6,595,305 | B1 | | 7/2003 | Dunn et al. |
| 6,601,662 | B2 | | 8/2003 | Matthias et al. |
| 6,725,952 | B2 | | 4/2004 | Singh |
| 6,745,645 | B2 | | 6/2004 | Griffo |
| 6,782,959 | B2 | | 8/2004 | Minikus et al. |
| 6,883,624 | B2 | | 4/2005 | McDonough |
| 6,929,079 | B2 | | 8/2005 | McDonough et al. |
| 7,013,999 | B2 | | 3/2006 | Tufts |
| 7,040,424 | B2 | | 5/2006 | Yong et al. |
| 7,086,489 | B2 | | 8/2006 | McDonough |
| 7,152,703 | B2 | | 12/2006 | Meiners et al. |
| 7,631,709 | B2 | | 12/2009 | McDonough et al. |
| 2004/0173384 | A1 | | 9/2004 | Yong et al. |
| 2005/0247492 | A1 | | 11/2005 | Shen et al. |
| 2008/0156543 | A1 | | 7/2008 | McDonough et al. |
| 2011/0031028 | A1 | | 2/2011 | Sreshta et al. |

FOREIGN PATENT DOCUMENTS

| | | | |
|---|---|---|---|
| EP | 0527506 | A2 | 2/1993 |
| EP | 0902159 | A2 | 3/1999 |
| GB | 2361497 | A | 10/2001 |
| GB | 2369841 | A | 6/2002 |
| GB | 2393982 | A | 4/2004 |
| GB | 2398330 | A | 8/2004 |
| RU | 2105124 | C1 | 2/1998 |
| RU | 2153569 | C2 | 7/2000 |
| WO | 01/61142 | A1 | 8/2001 |

* cited by examiner

ROCK BIT AND CUTTER TEETH GEOMETRIES

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of the Invention

The present invention relates generally to earth-boring bits used to drill a borehole for the ultimate recovery of oil, gas or minerals. More particularly, the invention relates to rolling cone rock bits and to an improved cutting structures for such bits.

2. Background of the Technology

An earth-boring drill bit is coupled to the lower end of a drill string and is rotated by revolving the drill string at the surface or by actuation of downhole motors or turbines, or by both methods. With weight applied to the drill string (i.e., weight-on-bit or WOB), the rotating drill bit engages the formation and forms a borehole along a predetermined path toward a target zone. The borehole formed in the drilling process has a diameter generally equal to the diameter or "gage" of the drill bit.

Earth boring bits used in oilfield drilling operations are frequently one of two types: fixed cutter bits or rolling cutter bits. Fixed cutter drill bits have multiple cutting surfaces that are pressed into and dragged through a formation. This type of bit primarily cuts the formation by shearing and scraping. Rolling cutter bits include one or more rotatable cutters that perform their cutting function due to the rolling movement of the cutters acting against the formation material. The cutters roll and slide upon the bottom of the borehole as the bit is rotated, the cutters thereby engaging and disintegrating the formation material in its path. The rotatable cutters may be described as generally conical in shape and are therefore sometimes referred to as rolling cones or rolling cone cutters. The earth disintegrating action of rolling cutter bits is enhanced by providing a plurality of cutters or cutting elements that extend from each of the rolling cones. Applying weight to the drill bit while rotating forces the cutting elements into engagement with the earth and rotates the cones. A rolling cutter drill bit primarily cuts the formation by compression, crushing, gouging, chipping and scraping. Two common classifications of rolling cutter drill bits include "insert" bits and "tooth" bits. In insert bits, the cutting elements extending from the cones comprise inserts that are press fit into undersized apertures in the cone surface prior to drilling with the bit. In tooth bits, the cutting elements comprise teeth that are milled, cast or otherwise integrally formed with the rolling cone.

While drilling, it is conventional practice to pump drilling fluid (also referred to as "drilling mud") down the length of the tubular drill string where it is jetted from the face of the drill bit through nozzles. The hydraulic energy thus supplied flushes the drilled cuttings away from the cutters and the borehole bottom, and carries them to the surface through the annulus that exists between the tubular drill string and the borehole wall.

In oil and gas drilling, the cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipes, which may be miles long, must be retrieved from the borehole, section-by-section. Once the drill string has been retrieved and the new bit installed, the bit must be lowered to the bottom of the borehole on the drill string, which again must be constructed section-by-section.

As is thus obvious, this process, known as a "trip" of the drill string, requires considerable time, effort and expense. Because drilling costs are typically thousands of dollars per hour, it is desirable to employ drill bits which will drill faster and longer, and which are usable over a wider range of formation hardnesses. The length of time that a drill bit may be employed before it must be changed depends upon its ability to "hold gage" (meaning its ability to maintain a full gage borehole diameter), its rate of penetration (ROP), as well as its durability or ability to maintain an acceptable ROP. For the foregoing reasons, it is desirable for the cutting elements of a rolling cone bit to be of a hard, strong, and durable material capable of drilling through hard and/or soft formations without rapid wear.

The shape and positioning of the cutting elements (both teeth and inserts) also impact bit durability and rate of penetration (ROP) and thus, are important to the success of a particular bit design. Cutting elements may have many different shapes, but are commonly chisel or conical in shape. When rolling cutters engage a formation under pressure, cracks develop in the formation and rock fragments and chips may become dislodged. As the cone rotates, the cutting elements penetrate the formation forming a crush zone beneath the tip of each cutter element. As each cutter element penetrates further into the formation, cracks may be formed around the crater created by the cutter element. Chisel shaped cutters commonly form a pair of hertzian cracks at each end of the crest that lead to chip formation. The size of the chips formed while drilling is generally related to the ROP of the drill bit.

During operation, cutting elements undergo large stress fluctuations due to the rotation of the rolling cutters. Large stresses and large stress fluctuations may cause cutting elements to break. As cutting elements penetrate the formation, the stresses typically increase. When cracks form in the formation, some cutter element stress is relieved immediately as the cutter element penetrates further into the formation. Large stress fluctuations also have an effect on the bit bearings positioned between each roller cone and a journal extending from the bit body, and can negatively impact bit bearing operational life.

Accordingly, there remains a need in the art for a drill bits and associated cutting elements that provide a relatively high rate-of-penetration and footage drilled, while at the same time, minimize the effects of wear and the tendency for breakage. Such bits would be particularly well received if they enhanced formation chip size and removal, while minimizing stresses imposed on the cutting elements and bearings.

BRIEF SUMMARY OF THE DISCLOSURE

These and other needs in the art are addressed in one embodiment by a rolling cone drill bit for cutting a borehole. In an embodiment, the bit comprises a bit body including a bit axis. In addition, the bit comprises a rolling cone cutter mounted on the bit body and adapted for rotation about a cone axis. Further, the bit comprises a tooth extending from the cone cutter. The tooth includes a base at the cone cutter and an elongate chisel crest distal the cone cutter. The crest extends along a crest median line between a first crest end and a second crest end and includes an elongate crest apex. The tooth also includes a first flanking surface extending from the base to the crest, and a second flanking surface extending from the base to the crest. The first flanking surface and the second flanking surface taper towards one another to form the chisel crest. Moreover, the tooth includes a first raised rib extending continuously along the first flanking surfaces and across the chisel crest to the second flanking surface.

These and other needs in the art are addressed in another embodiment by a rolling cone drill bit for cutting a borehole. In an embodiment, the bit comprises a bit body including a bit axis. In addition, the bit comprises a rolling cone cutter mounted on the bit body and adapted for rotation about a cone axis. Further, the bit comprises a tooth extending from the cone cutter. The tooth includes a base at the cone cutter and an elongate chisel crest distal the cone cutter. The crest extends along a crest median line between a first crest end and a second crest end and includes an elongate crest apex. The tooth also includes a first flanking surface extending from the base to the crest, and a second flanking surface extending from the base to the crest. The first flanking surface and the second flanking surface taper towards one another to form the chisel crest. Moreover, the tooth includes a first groove extending continuously along the first flanking surfaces and across the chisel crest to the second flanking surface.

These and other needs in the art are addressed in another embodiment by a rolling cone drill bit for cutting a borehole. In an embodiment, the bit comprises a bit body including a bit axis. In addition, the bit comprises a rolling cone cutter mounted on the bit body and adapted for rotation about a cone axis. Further, the bit comprises a tooth extending from the cone cutter. The tooth includes a trilateral base at the cone cutter and a tip distal the cone cutter. The tooth also includes a plurality of flanking surfaces, each flanking surface extending from the base to the tip, and each flanking surface extending between a pair of adjacent flanking surfaces. The flanking surfaces taper towards one another to form the tip.

These and other needs in the art are addressed in another embodiment by a rolling cone drill bit for cutting a borehole. In an embodiment, the bit comprises a bit body including a bit axis. In addition, the bit comprises a rolling cone cutter mounted on the bit body and adapted for rotation about a cone axis. Further, the bit comprises a tooth extending from the cone cutter. The tooth includes a base at the cone cutter. The tooth also includes an elongate chisel crest distal the cone cutter, wherein the crest extends along a crest median line between a first crest end and a second crest end. Still further, the tooth includes a first flanking surface and a second flanking surface, each flanking surface extending from the base to the crest. The first flanking surface and the second flanking surface taper towards one another to form the chisel crest. Moreover, the tooth includes a first end surface extending from the base to the first crest end and a second end surface extending between the base to the second crest end. The first end surface and the second end surface each extend between the first flanking surface and the second flanking surface. The first flanking surface is concave between the first and second end surfaces and the second flanking surface is convex between the first and second end surfaces. The crest has an apex disposed at a height $H_a$ measured perpendicularly from the cone cutter to the apex. The first crest end is disposed at a height $H_1$ measured perpendicularly from the cone cutter to the first crest end, the height $H_1$ being less than the height $H_a$.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
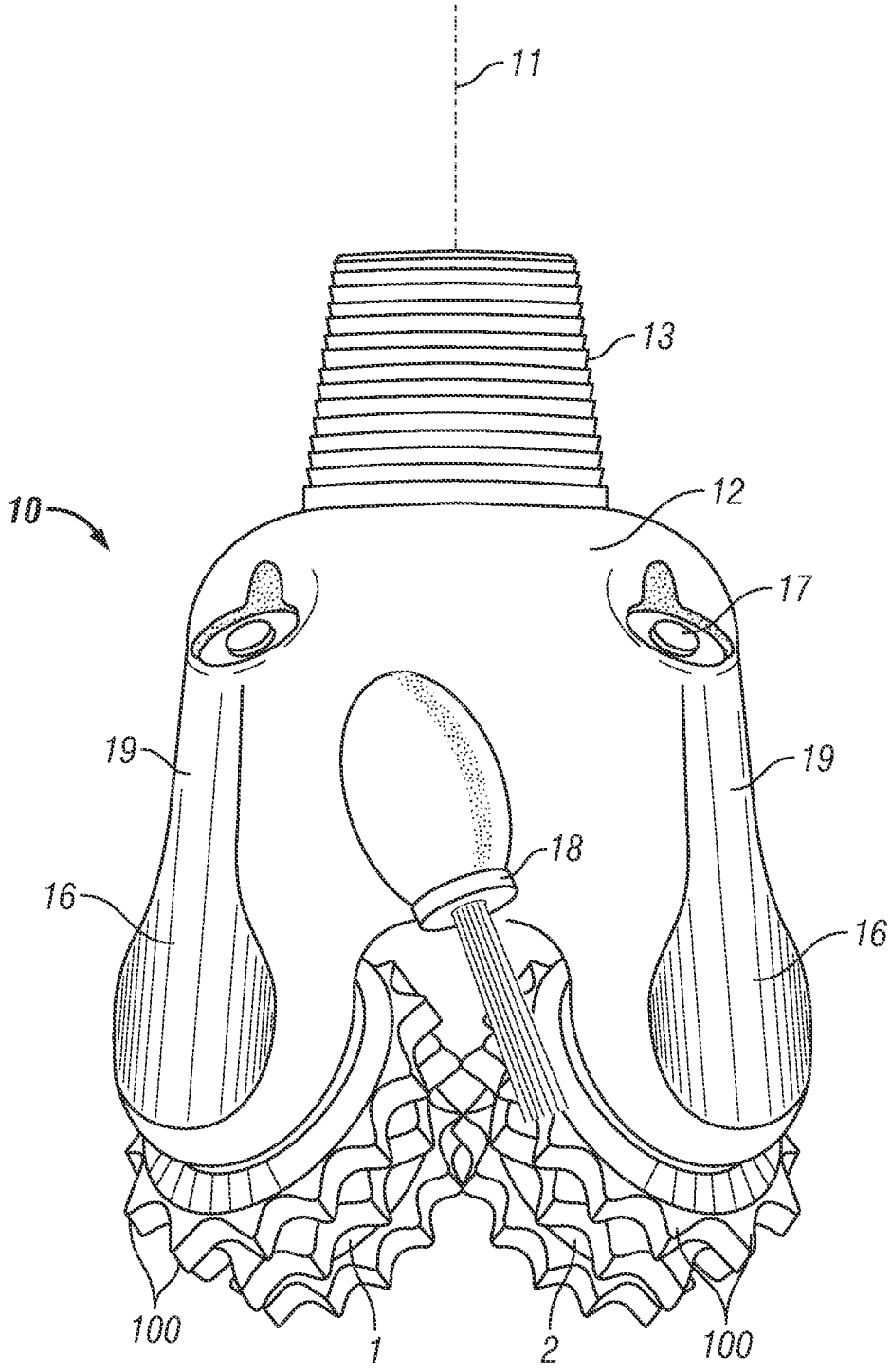
FIG. 1 (Prior Art)
FIG. 1 is a perspective view of a rolling cutter rock bit.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to limit the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Referring first to FIG. 1, a rolling cutter tooth bit 10 for drilling a borehole in an earthen formation is shown. Bit 10 includes a central axis 11 and a bit body 12 having a threaded pin section 13 at its upper end that couples bit 10 to the lower end of a drill string (not shown). Bit 10 has a predetermined gage diameter, defined by the outermost reaches of three rolling cone cutters 1, 2, 3 (cones 1 and 2 shown in FIG. 1), which are rotatably mounted on bearing shafts that extend from the bit body 12. Bit body 12 is composed of three sections or legs 19 (two legs shown in FIG. 1) that are welded together to form bit body 12. Bit 10 further includes a plurality of nozzles 18 that are provided for directing drilling fluid toward the bottom of the borehole and around cone cutters 1-3 during drilling operations. The drilling fluid exiting the nozzles 18 wash away the cuttings produced by cutters 1-3 and can assist in removing cuttings which may otherwise adhere to cutters 1-3. In addition, bit 10 includes lubricant reservoirs 17 that supply lubricant to the bearings that support each of the cone cutters 1-3. Bit legs 19 include a shirttail portion 16 that serves to protect the cone bearings and cone seals from damage caused by cuttings and debris entering between leg 19 and its respective cone cutter. Although the embodiment illustrated in FIG. 1 shows bit 10 as including three cone cutters 1-3, in other embodiments, bit 10 may include any number of cone cutters, such as one, two, three, or more rolling cone cutters.

Figure 2:
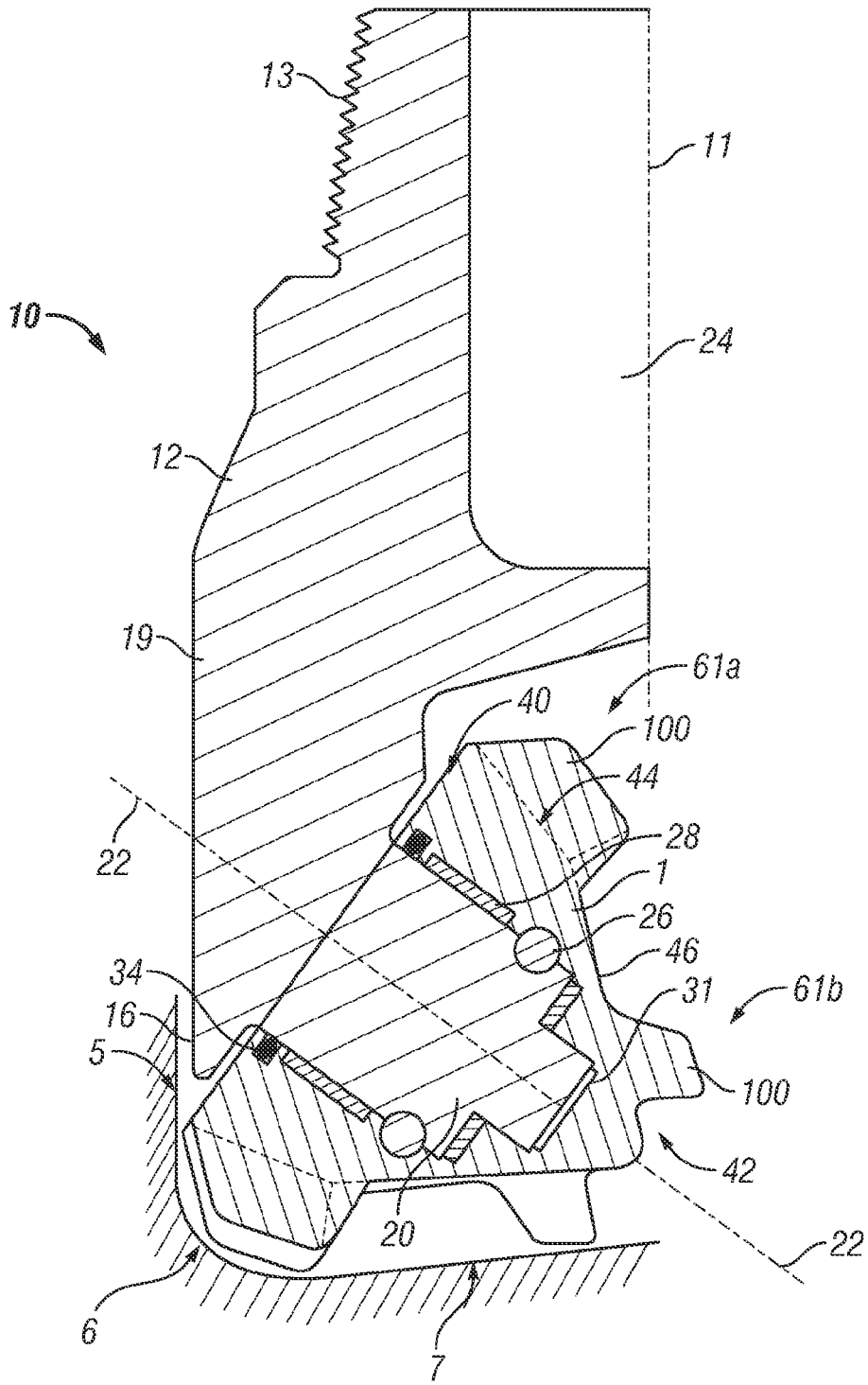
FIG. 2 (Prior Art)
FIG. 2 is a partial section view through one leg and one rolling cone cutter of the bit of FIG. 1.

Referring now to both FIGS. 1 and 2, each cone cutter 1-3 is mounted on a pin or journal 20 extending from bit body 12, and is adapted to rotate about a cone axis of rotation 22 oriented generally downwardly and inwardly toward the center of the bit. Each cutter 1-3 is secured on pin 20 by locking balls 26, in a conventional manner. In the embodiment shown, radial thrusts and axial thrusts are absorbed by journal sleeve 28 and thrust washer 31. The bearing structure shown is generally referred to as a journal bearing or friction bearing. However, the embodiments described herein are not limited to use in bits having such structure, but may equally be applied in a roller bearing bit where cone cutters 1-3 would be mounted on pin 20 with roller bearings disposed between the cone cutter and the journal pin 20. In both roller bearing and friction bearing bits, lubricant may be supplied from reservoir 17 to the bearings by apparatus and passageways that are omitted from the figures for clarity. The lubricant is sealed in the bearing structure, and drilling fluid excluded therefrom, by means of an annular seal 34 which may take many forms. Drilling fluid is pumped from the surface through fluid passage 24 where it is circulated through an internal passageway (not shown) to nozzles 18 (FIG. 1). The borehole created by bit 10 includes sidewall 5, corner portion 6 and bottom 7, best shown in FIG. 2.

Figure 3:
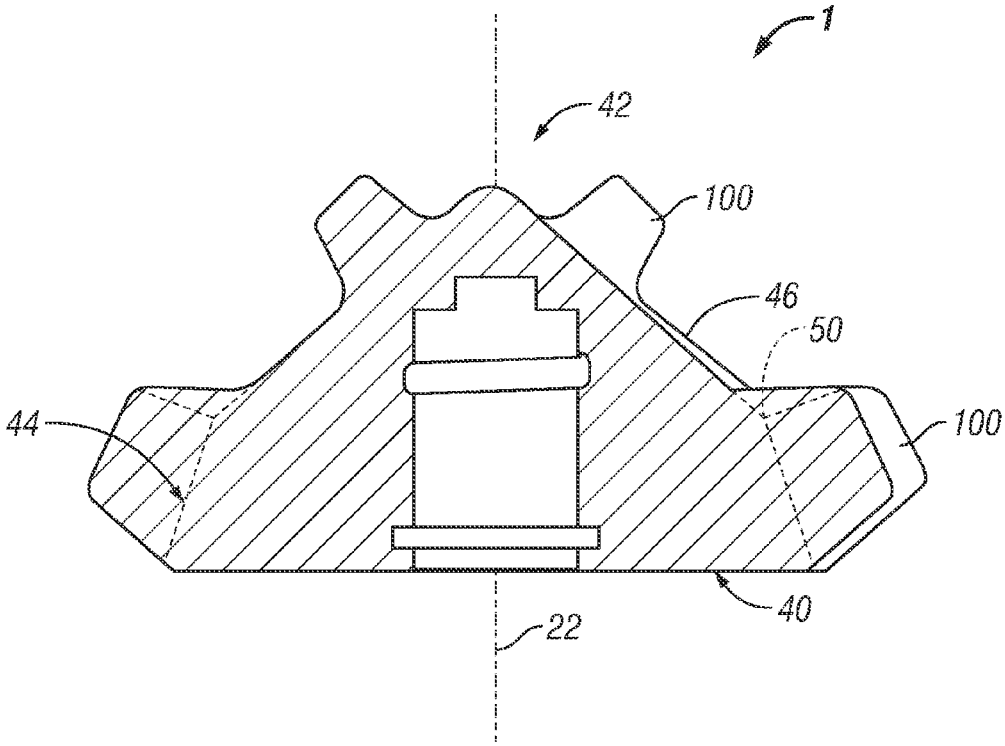
FIG. 3 (Prior Art)
FIG. 3 is an enlarged cross-sectional view of one of the roller cone cutters of the bit of FIG. 1.

Referring now to FIGS. 2 and 3, each rolling cone cutter 1-3 includes a generally planar backface 40 and nose 42 generally opposite backface 40. Adjacent to backface 40, cutters 1-3 further include a generally frustoconical surface 44. The cutting elements extending from surface 44 scrape or ream the sidewalls of the borehole as the cone cutters 1-3 rotate about the borehole bottom. Frustoconical surface 44 will be referred to herein as the "gage" surface of cone cutters 1-3, it being understood, however, that the same surface may be sometimes referred to by others in the art as the "heel" surface of a rolling cone cutter.

Extending between gage surface 44 and nose 42 is a slightly convex generally conical cone surface 46. The cutting elements extending from surface 46 gouge or crush the borehole bottom 7 as the cone cutters 1-3 rotate about the borehole. Frustoconical gage surface 44 and conical surface 46 converge in a circumferential edge or shoulder 50. Although referred to herein as an "edge" or "shoulder," it should be understood that shoulder 50 may be contoured, such as by a radius, to various degrees such that shoulder 50 will define a contoured zone of convergence between frustoconical gage surface 44 and the conical surface 46.

In bit 10 illustrated in FIGS. 1 and 2, each cone cutter 1-3 includes a plurality of wear resistant cutting elements or teeth 100. During drilling operations, the weight of the drilling string forces cutting teeth 100 of cutters 1-3 into the earth, and, as the bit 10 is rotated, the earth causes the cutters 1-3 to rotate upon pins 20 effecting a drilling action.

In general, the teeth of a rolling cone tooth bit (e.g., teeth 100 of bit 10) may be formed in a variety of ways. For example, the teeth may be attached to the rolling cone cutter by welding the tooth to the cone. Teeth may also be formed by machining the teeth from a rolling cone casting. Still further, the teeth may be incorporated into the cone through a forging process where a tooth and cone are formed together. One suitable forging process known in the art is rapid solid state densification powder metallurgy (RSSDPM). The RSSDPM process is disclosed in U.S. Pat. Nos. 4,368,788; 4,372,404; 4,398,952; 4,554,130; 4,562,892; 4,592,252; 4,597,456; 4,630,692; 4,853,178; 4,933,140; 4,949,598; 5,032,352; 5,653,299; 5,967,248; 6,045,750; 6,0100,016; 6,135,218; 6,338,621; and 6,347,676, each of which is hereby incorporated herein by reference in its entirety for all purposes. Such processes may be referred to herein as densification powdered metallurgy, powder forging process, powder forge cutter process or simply the PFC process. The powder forging process enables formation of teeth having shapes and configurations that may be difficult to be formed by other manufacturing methods.

Figure 4A:
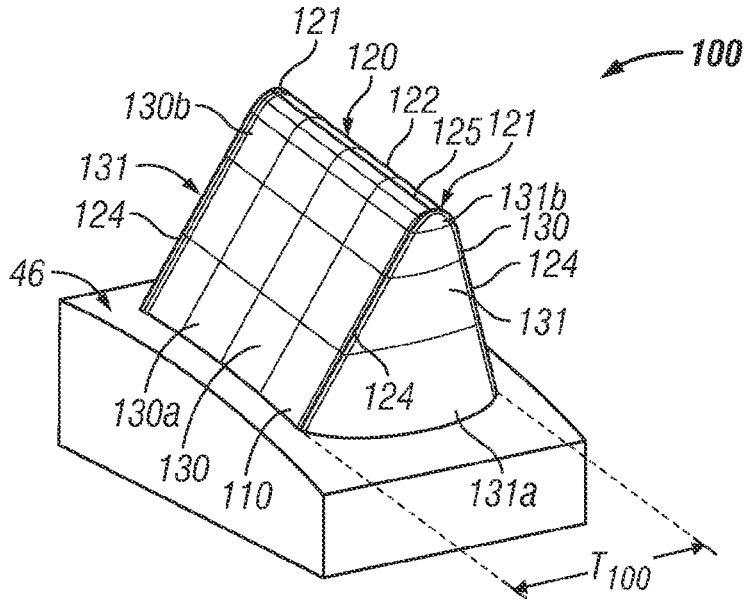
FIG. 4A (Prior Art)
FIG. 4*a* is a perspective view of a cutting tooth of the bit of FIG. 1.
Figure 4B:
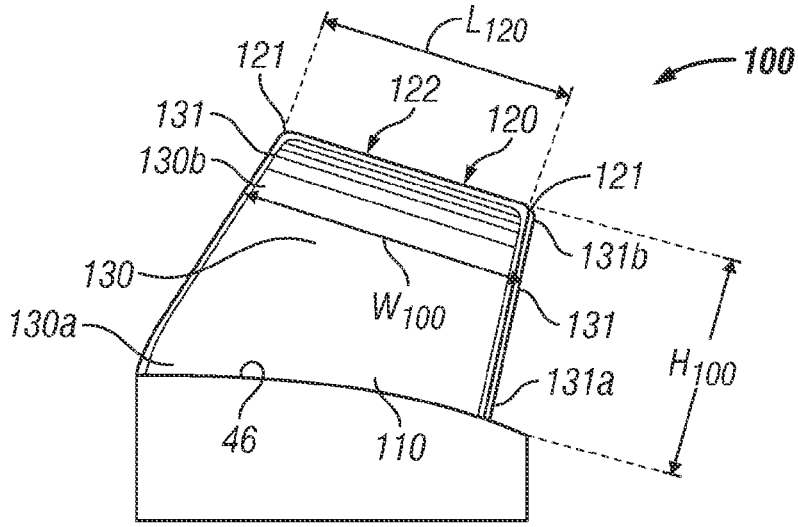
FIG. 4B (Prior Art)
FIG. 4*b* is a side view of the tooth of FIG. 5*a;*

Referring now to FIGS. 4*a* and 4*b*, one tooth 100 will be described, it being understood that each tooth 100 of bit 10 is similarly configured. Tooth 100 extends from a base 110 integral with its respective cutter 1-3 to an elongate crest 120 opposite base 110 and distal the cutter surface (e.g., surface 46). Crest 120 has an apex 122 and extends along a crest median line 125 between crest ends or corners 121. The length $L_{120}$ of crest 120 is measured along median line 125 between crest ends 121.

Tooth 100 is generally wedge-shaped, including a pair of flanking surfaces 130 and a pair of end surfaces 131. Flanking surfaces 130 taper or incline towards one another as they extend from base 110 and the cone surface to crest 120. In particular, each flanking surface 130 has a first or base end 130*a* at base 110, and a second or crest end 130*b* that intersects crest 120 distal base 110. Flanking surfaces 130 are planar, however, crest 120 is curved between flank ends 130*b*. Thus, the intersection of flanking surface 130 and crest 120 is defined by the transition from a planar surface to a curved, convex surface.

Referring still to FIGS. 4*a* and 4*b*, end surfaces 131 extend from base 110 to crest 120, and extend between flanking surfaces 130. In particular, each end surface 131 has a first or base end 131*a* at base 110, and a second or crest end 131*b* that intersects crest 120 at one corner 121. Similar to flanking surfaces 130, end surfaces 131 taper or incline towards each one another as they extend from the cone surface and base 110 to crest 120. As best shown in the side view of FIG. 4*b*, a first end surface 131 (the end surface 131 on the right in FIG. 4*b*) extends perpendicularly from the cone surface, and a second end surface 131 (the end surface 131 on the left in FIG. 4*b*) is generally angled or inclined towards the first end surface 131 as it extends toward crest 120. A continuous edge 124 extends along the intersection of each end surface 131 with flanking surfaces 130 and crest 120. As best shown in FIG. 4*a*, end surfaces 131 are slightly convex or outwardly bowed.

Tooth 100 has a height $H_{100}$ measured perpendicularly from apex 122 to the cone surface in side view (FIG. 4*b*). Further, tooth 100 has a thickness $T_{100}$ measured between flanking surfaces 130 and a width $W_{100}$ measured between end surfaces 131. Since flanking surfaces 130 are inclined towards each other moving away from base 110, thickness $T_{100}$ decreases moving toward crest 120. Likewise, since end surfaces 131 are inclined towards each other moving away from base 110, width $W_{100}$ also decreases moving toward crest 120.

As rolling cutters 1-3 rotate during drilling, elongated crests 120 are forced into the formation. In general, the "sharper" a tooth (e.g., tooth 100) is, the deeper it will penetrate the formation at a given WOB. The shape and sharpness of a tooth is generally determined by its height $H_{100}$, its thickness $T_{100}$ at base 110 and crest 120, its width 112 at base 110 and crest 120, and the length $L_{120}$ of crest 120.

Referring again to FIG. 2, cone 1 includes a plurality of teeth 100 extending from gage surface 44 and arranged in a circumferential gage row 61*a*. Teeth 100 in row 61*a*, which may also be referred to as "gage" teeth, cut the sidewall 5 and the corner portion 6 of the borehole (i.e., a portion of sidewall 5 and a portion of borehole bottom 7). Axially between gage row 61*a* and nose 42, cone 1 includes a plurality of teeth 100 extend from surface 46 and arranged in a circumferential row 61*b*. Teeth 100 in row 61*b*, which may also be referred to as "inner row" teeth or "bottomhole" teeth, cut the borehole bottom 7. Thus, as used herein, the phrases "inner row" and "bottomhole" may be used to describe cutting teeth that engage the borehole bottom (e.g., borehole bottom 7), and do not engage the borehole sidewall (e.g., borehole sidewall 5) or corner (e.g., borehole corner 6). In other words, teeth 100 in row 61*a* are not inner row or bottomhole teeth. Although only cone cutter 1 is shown in FIG. 2, cones 2 and 3 are similarly, although not identically, configured.

Figure 5A:
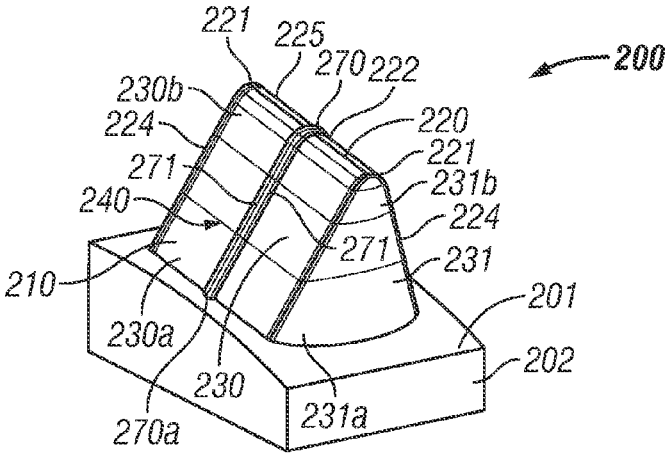
FIG. 5*a* is a perspective view of an embodiment of a cutting tooth having particular application in a rolling cutter bit such as that shown in FIGS. 1 and 2.
Figure 5B:
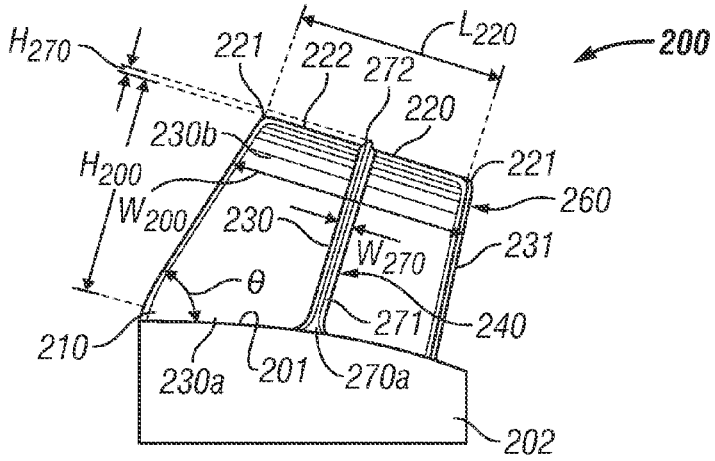
FIG. 5*b* is a side view of the cutting tooth of FIG. 5*a;*
Figure 5C:
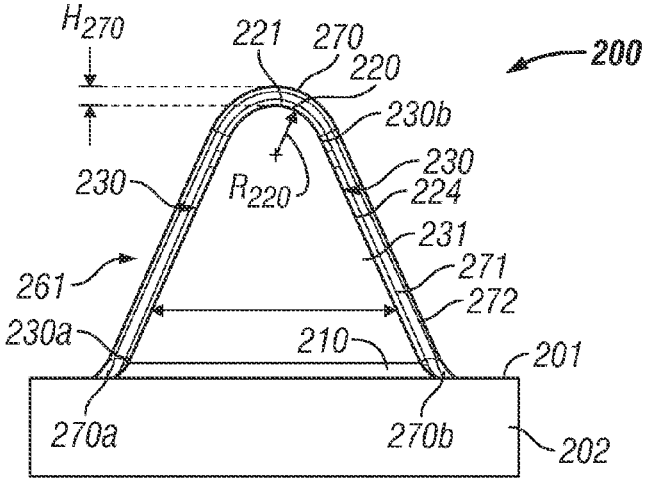
FIG. 5*c* is an end view of the cutting tooth of FIG. 5*a;*

Referring now to FIGS. 5*a*-5*c*, an embodiment of a cutting element or tooth 200 believed to have particular utility when employed in a rolling cutter tooth bit, such as in gage row 61*a* or inner row 61*b* shown in FIGS. 1-3 above, is shown. However, it should be appreciated that tooth 200 may also be employed in other rows and other regions on the rolling cone cutter. In FIGS. 5*a*-5*c*, tooth 200 is shown extending from the surface 201 of a rolling cone cutter 202.

Tooth 200 has a base 210 monolithically formed with cutter 202 and an elongate chisel crest 220 distal base 210. Crest 220 extends between crest ends or corners 221 and comprises an apex 222. In this embodiment, crest 220 extends linearly between crest corners 221 along a crest median line 225. The length $L_{220}$ of crest 120 is measured along median line 225 between crest ends 221.

Tooth 200 is generally wedge-shaped, including a pair of flanking surfaces 230 and a pair of end surfaces 231. Flanking surfaces 230 taper or incline towards one another as they extend from base 210 to crest 220. In particular, each flanking surface 230 has a first or base end 230*a* at base 210, and a second or crest end 230*b* that intersects crest 220. End surfaces 231 also extend from base 210 to crest 220. In particular, end surfaces 231 extend from base 210 to crest ends 221, and generally extend between flanking surfaces 230. Each end surface 231 has a first or base end 231*a* at base 210, and a second or crest end 231*b* that intersects crest 220 at one corner 221. Similar to flanking surfaces 230, end surfaces 231 taper or incline towards each one another as they extend from base 210 to crest 220. As best shown in the side view of FIG. 5*b*, a first end surface 231 (the end surface 231 on the right in FIG. 5*b*) extends perpendicularly from cone surface 201, however, a second end surface 231 (the end surface 231 on the left in FIG. 5*b*) is angled or inclined towards the first end surface 231 as it extends toward crest 220. In particular, the second end surface 231 is generally oriented at an acute angle θ relative to a tangent to cone surface 201 at the intersection of cone surface 201 and end surface 231 in side view. A continuous edge 224 extends along the intersection of each end surface 231 with flanking surfaces 230 and crest 220. Although referred to as an "edge," the intersection between end surfaces 231 with flanking surfaces 230 and crest 220 may be radius or rounded. As best shown in FIG. 5*a*, in this embodiment, end surfaces 231 are slightly convex or outwardly bowed, however, in other embodiments, the end surfaces (e.g., surfaces 231 may be planar or concave).

Tooth 200 has a height $H_{200}$ measured perpendicularly from apex 220 to the cone surface 201 in side view (FIG. 5*b*). In this embodiment, crest 220 is not parallel to the cone surface 201 in side view, and thus, height $H_{200}$ varies moving along crest 220 between ends 221. In particular, height $H_{200}$ decreases moving from the left crest end 221 to the right crest end 221 in FIG. 5*b*. Further, tooth 200 has a thickness $T_{200}$ measured parallel to cone surface 201 between flanking surfaces 230 in side view and a width $W_{200}$ measured parallel to apex 222 between end surfaces 231 in side view. Since flanking surfaces 230 are inclined towards each other moving away from base 210, thickness $T_{200}$ decreases moving toward crest 220. Likewise, since end surfaces 231 are inclined towards each other moving away from base 210, width $W_{200}$ also decreases moving toward crest 220.

Referring now to the side and end views of FIGS. 5*b* and 5*c*, respectively, end surfaces 231 and crest 220 define a side periphery or profile 260 of tooth 200 (FIG. 5*b*), while flanking surfaces 230 and crest 220 define an end periphery or profile 261 of tooth 200 (FIG. 5*c*). It is to be understood that in general, the term "profile" may be used to refer to the shape and geometry of the outer periphery of a tooth in side view or end view. In particular, the "end profile" of a tooth reveals the tooth's profile and geometry in end view, while the "side profile" of a tooth reveals the tooth's profile and geometry in side view.

As seen in side profile 260 (FIG. 5*b*), lateral surfaces 231 are generally straight in the region between base 210 and crest 220. Likewise, as seen in end profile 261 (FIG. 5*c*), flanking surfaces 230 are generally straight in the region between base 210 and crest 220. Consequently, in side and end profiles 260, 261, end surfaces 231 and flanking surfaces 230, respectively, each have a substantially constant radius of curvature in the region between base portion 210 and crest 220. It is to be understood that a straight line, as well as a flat or planar surface, has a constant radius of curvature of infinity. Although surfaces 230, 231 of the embodiment shown in FIGS. 5*a*-5*c* are substantially straight in the region between base 210 and crest 220 as illustrated in profiles 261, 260, respectively, in other embodiments, the flanking surfaces (e.g., flanking surfaces 230) and/or the end surfaces (e.g., end surfaces 231) may be curved or arcuate between the base (e.g., base 110) and the crest (e.g., crest 220).

As previously described, in profiles 260, 261, end surfaces 231 and flanking surfaces 230, respectively, are substantially straight, each having a constant radius of curvature in the region between base 210 and crest 220. The transition from surfaces 230, 231 to crest 220 generally occurs where the substantially straight surfaces 230, 231 begin to curve in profiles 261, 260, respectively. In other words, the points in profiles 260, 261 at which the radius of constant curvature of surfaces 231, 230, respectively, begin to change marks the transition into crest 220.

As shown in FIG. 5*b*, crest 220 is straight in side profile 260 between crest ends 221. However, as shown in FIG. 5*c*, crest 220 is smoothly curved between flank surface ends 231*a, b* in end profile 261. In particular, in end profile view 261, crest 220 is convex or bowed outward between ends 231*a, b* of flanking surfaces 231 along its entire length $L_{220}$, and has a constant radius of curvature $R_{220}$ between ends 231*a, b* along its entire length $L_{220}$.

Referring still to FIGS. 5*a*-5*c*, tooth 200 also includes a discontinuity 240 extending along each flanking surface 230 and across crest 220. In this embodiment, discontinuity 240 is a raised rib 270 that is integral with and monolithically formed with tooth 200. Rib 270 extends continuously along each flanking surface 230 and across crest 220. In particular, rib 270 extends along a longitudinal axis 275 from a first end 270*a* on one flanking surface 230 at cone surface 201 to a second end 270*b* on the other flanking surface 230 at cone surface 201. As best shown in the side view of FIG. 5*b*, in this embodiment, longitudinal axis 275 is oriented perpendicular to crest median line 225 and apex 222 on both flanking surfaces 230, extends linearly from crest 220 to each end 270*a, b*, and is centered on crest 220 relative to crest ends 221.

As previously described, in this embodiment, rib 270 is centered relative to crest ends 221 and extends perpendicularly from crest 220 along both flanking surfaces 230 to cone surface 201. However, in other embodiments, multiple ribs (e.g., ribs 270) may be provided, one or more rib(s) may be disposed at the center of the crest (e.g., crest 220) or offset from the center of the crest, one or more rib(s) may extend perpendicularly or at an acute angle from the crest in side view, one or more rib(s) may extend from the crest along one or both of the flanking surfaces, one or more rib(s) may extend from the crest to the cone surface or terminate short of the cone surface, or combinations thereof.

As best shown in FIG. 5*b*, rib 270 is formed by a pair of flanking surfaces 271 that taper or incline towards each other as they extend from flanking surfaces 230 and crest 220 to a peak 272. In this embodiment, peak 272 is radiused to reduce stress concentrations. Rib 270 extends to a height $H_{270}$ measured perpendicularly from either flanking surface 230 or crest 220 to peak 272. In general, the height $H_{270}$ of rib 270 may be varied depending on a variety of factors including, without limitation, the formation type, the anticipated WOB, the bit RPM, or combinations thereof. However, height $H_{270}$ of rib 270 is preferably 5-20% of height $H_{200}$ of tooth 200, and more preferably 10-15% of height $H_{200}$ of tooth 200. In this embodiment, the height $H_{270}$ of rib 270 is 10% of the height $H_{200}$ of tooth 200 at the lengthwise center of apex 222 (i.e., at the midpoint of apex 222 relative to crest ends 221). Since rib 270 extends from to height $H_{270}$ from apex 222, rib 270 contacts the formation prior to crest 220. In addition, rib 270 has a width $W_{270}$ measured perpendicular to axis 275 (in side view) between surfaces 271. Since surfaces 271 are inclined towards each other, width $W_{270}$ is maximum at the intersection of rib 270 with flanking surfaces 230 and crest 220, and minimum at peak 272. In general, the maximum and minimum widths $W_{270}$ of rib 270 may be varied depending on a variety of factors including, without limitation, the formation type, the anticipated WOB, the bit RPM, or combinations thereof. However, the ratio of the rib height $H_{270}$ to the rib width $W_{270}$ (i.e., $H_{270}/W_{270}$) is preferably between 0.25 and 0.60. In addition, the maximum width $W_{270}$ of rib 270 is preferably 10-30% of length $L_{220}$ of crest 120, and more preferably 15-20% of length $L_{220}$ of crest 120. In this embodiment, the maximum width $W_{270}$ of rib 270 is 15% of the length $L_{220}$ of crest 220.

In this embodiment, the geometry of rib 270 is uniform along its entire length, and thus, height $H_{270}$ of rib 270 is uniform between ends 270*a, b*, width $W_{270}$ at flanking surfaces 230 and crest 220 is uniform between ends 270*a, b*, and width $W_{270}$ at peak 272 is uniform between ends 270*a, b*. In other embodiments, the height of the rib (e.g., height $H_{270}$ of rib 270), the maximum width of the rib (e.g., width $W_{270}$ at surfaces 230 and crest 222), the minimum width of the rib (e.g., width $W_{270}$ at peak 272), or combinations thereof may vary along the rib's length.

Figure 6:
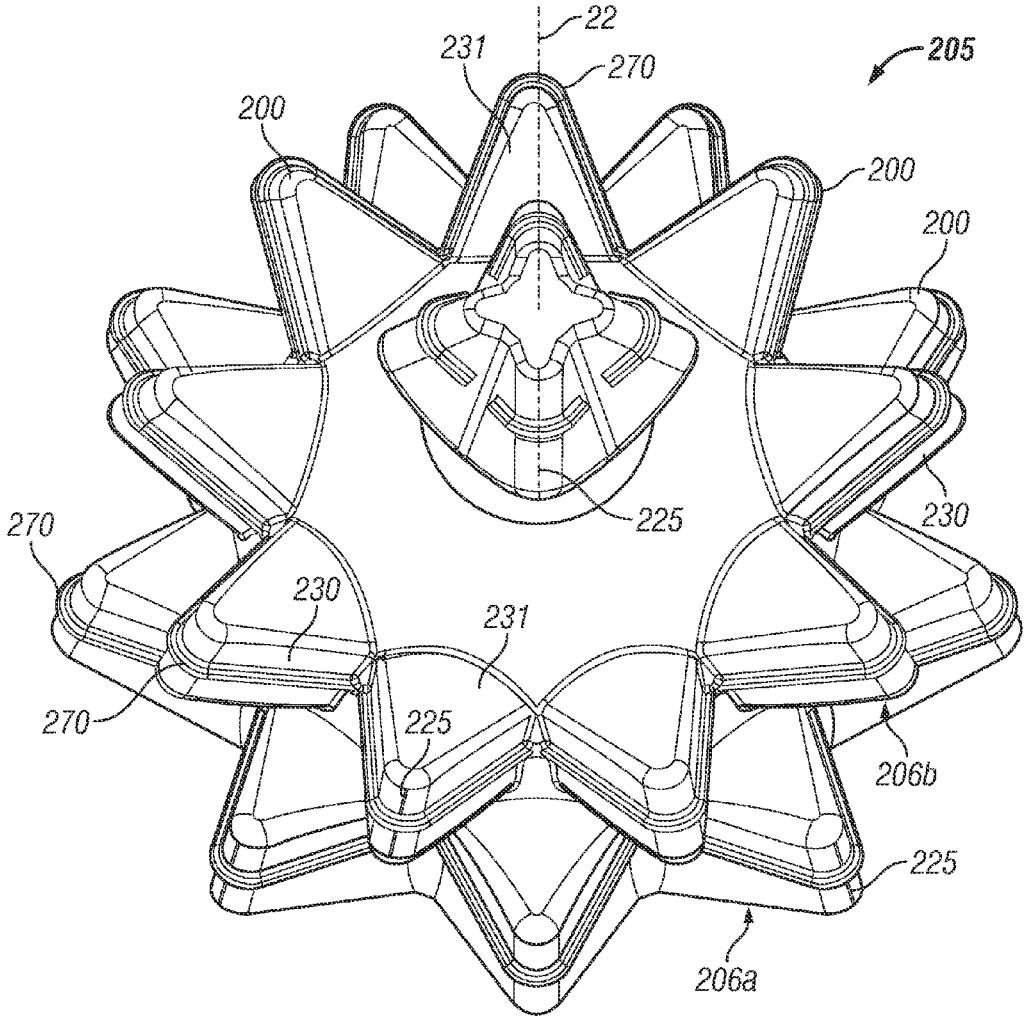
FIG. 6 is a perspective view of a rolling cone cutter having the cutting tooth of FIGS. 5*a*-5*c* mounted therein.

Referring now to FIG. 6, tooth 200 described above is shown mounted in a rolling cone cutter 205 as may be employed, for example, in bit 10 described above with reference to FIGS. 1 and 2, with cone cutter 205 substituted for any of the cones 1-3 previously described. As shown, cone cutter 205 includes a plurality of teeth 200 disposed in a circumferential gage row 206*a* and a plurality of teeth 200 disposed in a circumferential inner row 206*b*. In this embodiment, teeth 200 are all oriented such that a projection of crest median line 225 is aligned with cone axis 22. However, in other embodiments, teeth 200 may be mounted in other orientations, such as in an orientation where a projection of the crest median line 225 of one or more teeth 200 is skewed relative to the cone axis.

Figure 7A:
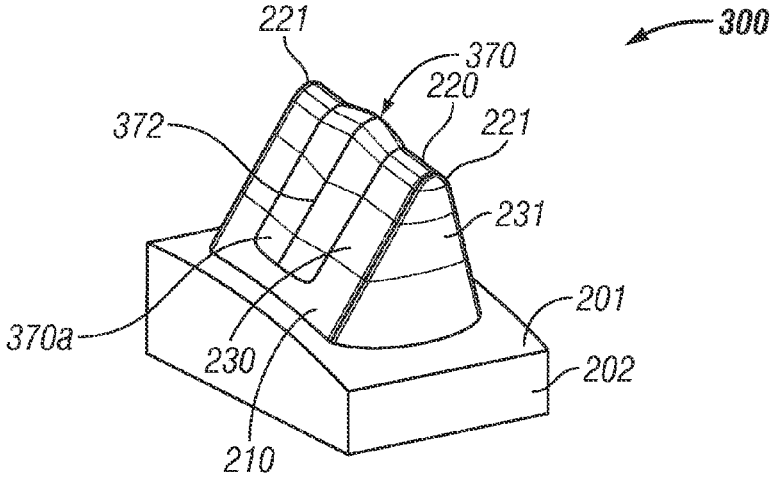
FIG. 7*a* is a perspective view of an embodiment of a cutting tooth having particular application in a rolling cutter bit such as that shown in FIGS. 1 and 2.
Figure 7B:
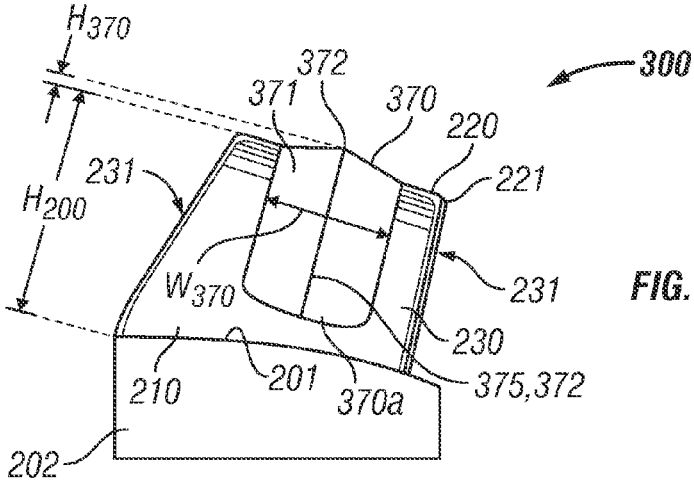
FIG. 7*b* is a side view of the cutting tooth of FIG. 7*a;*
Figure 7C:
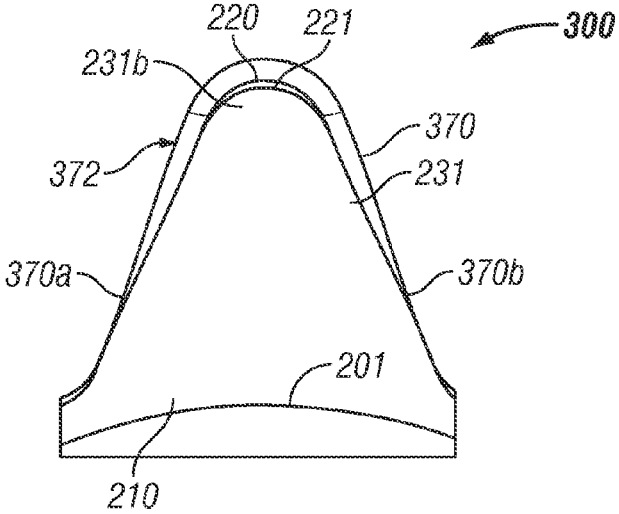
FIG. 7*c* is an end view of the cutting tooth of FIG. 7*a;*

Referring now to FIGS. 7*a*-7*c*, an embodiment of a cutting element or tooth 300 believed to have particular utility when employed in a rolling cutter tooth bit, such as in gage row 61*a* or inner row 61*b* shown in FIGS. 1-3 above, is shown. However, it should be appreciated that tooth 300 may also be employed in other rows and other regions on the rolling cone cutter. In FIGS. 7*a*-7*c*, tooth 300 is shown extending from the surface 201 of a rolling cone cutter 202.

Tooth 300 is substantially the same as tooth 200 previously described. Namely, tooth 300 is generally wedge-shaped and has a base 210 monolithically formed with cutter 202, an elongate chisel crest 220 distal base 210, a pair of flanking surfaces 230, and a pair of end surfaces 231, each as previously described.

Tooth 300 also includes a raised rib 370 similar to rib 270 previously described. Rib 370 is integral with and monolithically formed with tooth 300. Further, rib 370 has a longitudinal axis 375 and extends continuously along both flanking surfaces 230 and across crest 220 between a first end 370*a* and a second end 370*b*. As best shown in the side view of FIG. 7*b*, longitudinal axis 375 is oriented perpendicular to apex 222 along each flanking surface 230, extends linearly down each flanking surface 230 from crest 220, and is centered along crest 220 relative to crest ends 222. Further, rib 370 has a height $H_{370}$ measured perpendicularly from each flanking surface 230 and crest 220. As best shown in FIG. 7*b*, rib 370 is formed by a pair of flanking surfaces 371 that taper or incline towards each other as they extend from flanking surfaces 230 and crest 220 to a peak 372. In this embodiment, peak 372 is radiused to reduce stress concentrations. Moreover, rib 370 has a width $W_{370}$ measured perpendicular to axis 375 (in side view) between surfaces 371. Since surfaces 371 forming rib 370 are inclined towards each other, width $W_{370}$ is maximum at flanking surfaces 230 and crest 220, and is minimum at peak 372. As with rib 270 previously described, in this embodiment, height $H_{370}$, the maximum width $W_{370}$, and the minimum width $W_{370}$ are uniform along the entire length of rib 370. However, unlike rib 270, in this embodiment, each end 370*a, b* is spaced from cone surface 201. In other words, rib 370 does not extend to cone surface 201. Still further, the maximum width $W_{370}$ of rib 370 at flanking surfaces 230 and crest 220, relative to the width $W_{200}$ of tooth 300 at apex 222, is significantly greater than the width $W_{270}$ of rib 270. Specifically, in this embodiment, the maximum width $W_{370}$ of rib 370 is 50% of the width $W_{200}$ of tooth 300 at apex 222.

Although tooth 300 includes only one rib 370 that is centered relative to crest ends 221 and extends perpendicularly from crest 220 along both flanking surfaces 230, in other embodiments, more than one rib (e.g., rib 370) may be provided, the one or more rib(s) may extend perpendicularly or at an acute angle from the crest (e.g., crest 220) in side view, one or more rib(s) may extend from the crest along one or both of the flanking surfaces, one or more rib(s) may extend from the crest to the cone surface or terminate short of the cone surface, or combinations thereof. Moreover, although the geometry of rib 370 is uniform along its entire length, in other embodiments, the height of the rib (e.g., height $H_{370}$ of rib 370), the maximum width of rib (e.g., width $W_{370}$ at surfaces 230 and crest 222), the minimum width of rib (e.g., width $W_{370}$ at peak 372), or combinations thereof may be different and/or vary along each rib's length.

Figure 8:
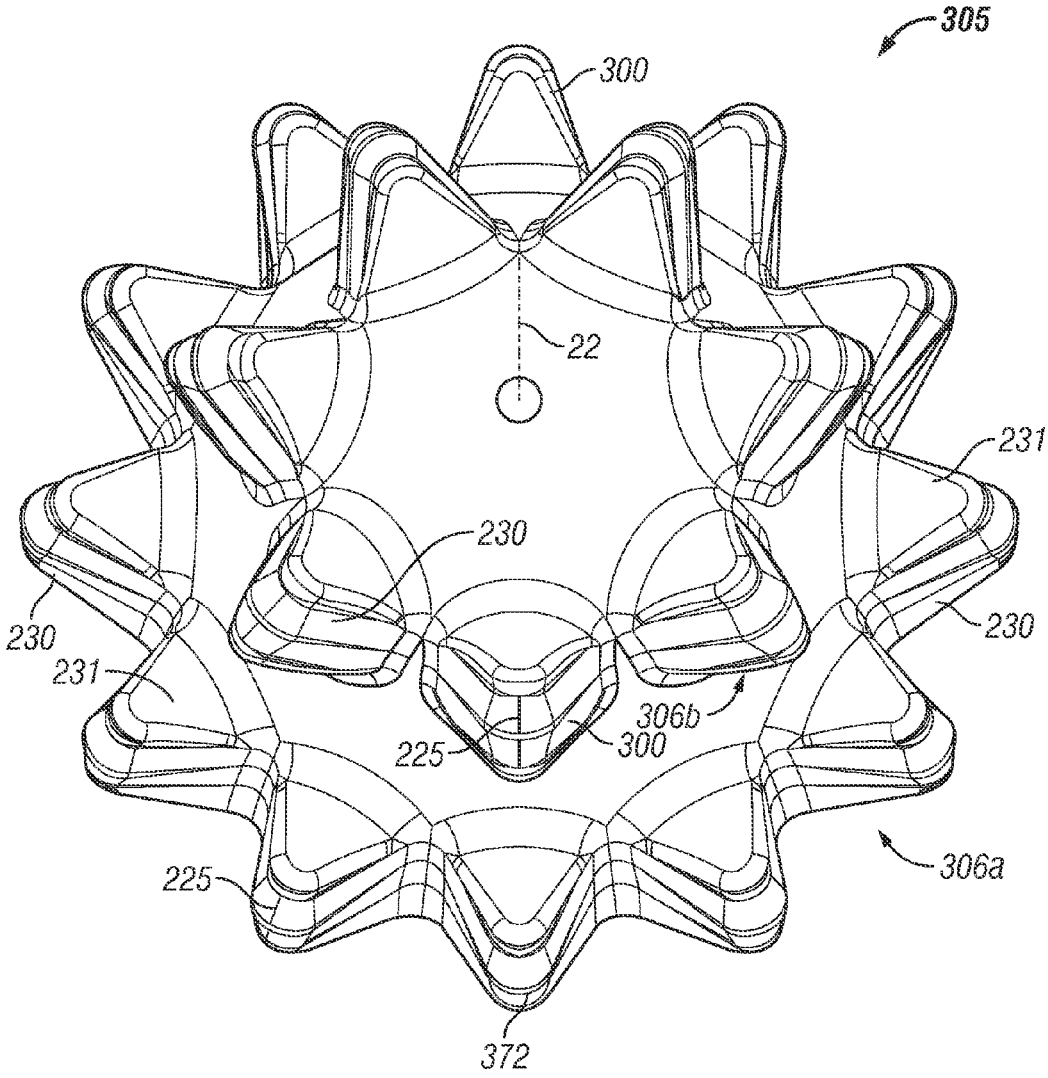
FIG. 8 is a perspective view of a rolling cone cutter having the cutting tooth of FIGS. 7*a*-7*c* mounted therein.

Referring now to FIG. 8, tooth 300 described above is shown mounted in a rolling cone cutter 305 as may be employed, for example, in bit 10 described above with reference to FIGS. 1 and 2, with cone cutter 305 substituted for any of the cones 1-3 previously described. As shown, cone cutter 305 includes a plurality of teeth 300 disposed in a circumferential gage row 306*a* and a plurality of teeth 300 disposed in a circumferential inner row 306*b*. In this embodiment, teeth 300 are all oriented such that a projection of crest median line 225 is aligned with cone axis 22. However, in other embodiments, teeth 300 may be mounted in other orientations, such as in an orientation where a projection of the crest median line 225 of one or more teeth 300 is skewed relative to the cone axis.

Figure 9A:
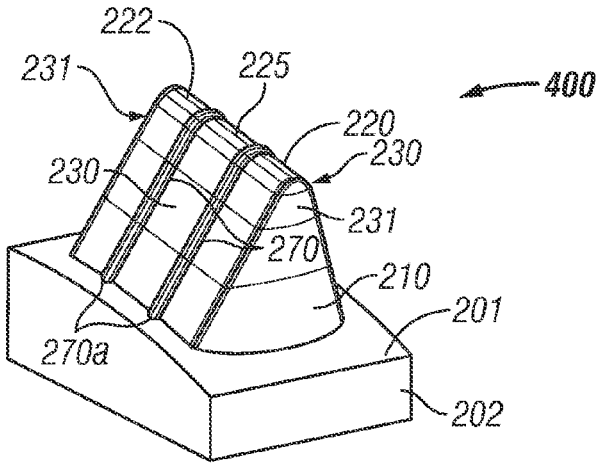
FIG. 9*a* is a perspective view of an embodiment of a cutting tooth having particular application in a rolling cutter bit such as that shown in FIGS. 1 and 2.
Figure 9B:
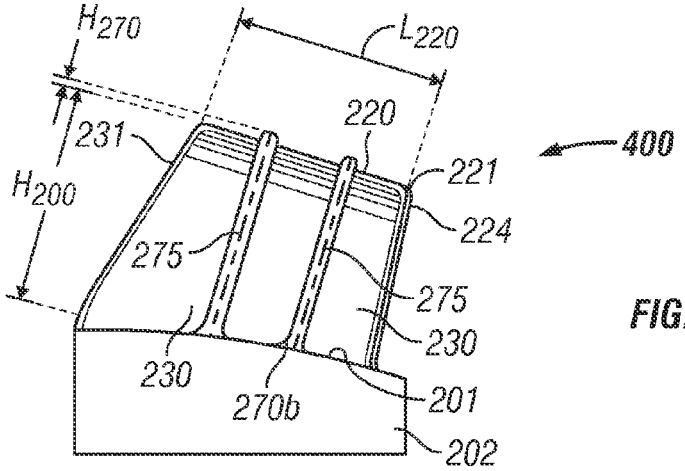
FIG. 9*b* is a side view of the cutting tooth of FIG. 9*a;*
Figure 9C:
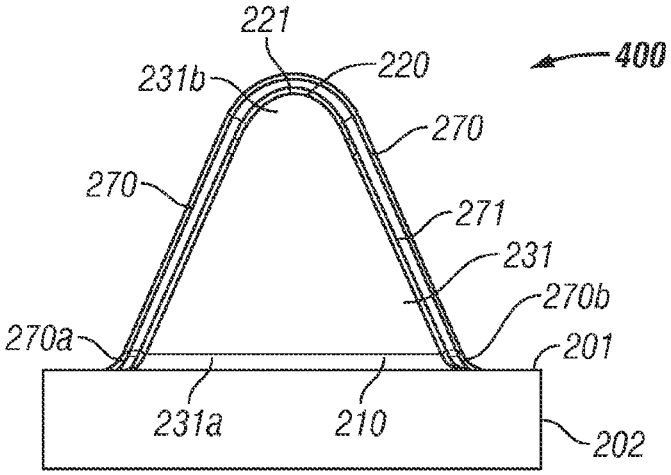
FIG. 9*c* is an end view of the cutting tooth of FIG. 9*a;*

Referring now to FIGS. 9*a*-9*c*, an embodiment of a cutting element or tooth 400 believed to have particular utility when employed in a rolling cutter tooth bit, such as in gage row 61*a* or inner row 61*b* shown in FIGS. 1-3 above, is shown. However, it should be appreciated that tooth 400 may also be employed in other rows and other regions on the rolling cone cutter. In FIGS. 9*a*-9*c*, tooth 400 is shown extending from the surface 201 of a rolling cone cutter 202.

Tooth 400 is substantially the same as tooth 200 previously described. Namely, tooth 400 is generally wedge-shaped and has a base 210 monolithically formed with cutter 202, an elongate chisel crest 220 distal base 210, a pair of flanking surfaces 230, and a pair of end surfaces 231, each as previously described. However, unlike tooth 200 that includes only one raised rib 270, in this embodiment, tooth 400 includes two ribs 270, each as previously described. As best shown in FIG. 9*b*, each rib 270 is oriented perpendicular to crest median line 225 and apex 222, and extends linearly from crest 220 down each flanking surface 230 to the cone surface 201. However, in this embodiment, neither rib 270 is centered on crest 220 relative to crest ends 221. Instead, ribs 270 are uniformly distributed across crest 220—median line 275 of one rib 270 is spaced one-third (⅓) the crest length $L_{220}$ from one crest end 221, median line 275 of the other rib 270 is spaced one-third (⅓) the crest length $L_{220}$ from the other crest end 221, and the median lines 275 of ribs 270 are spaced apart one-third (⅓) the crest length $L_{220}$. Although neither rib 270 is centered on crest 220, and ribs 270 are uniformly distributed across crest 220 in this embodiment, in other embodiments including multiple ribs (e.g., ribs 270), one rib may be centered on the crest (e.g., crest 220) and the ribs may be non-uniformly distributed along the crest relative to the crest ends (e.g., crest ends 221).

Figure 10:
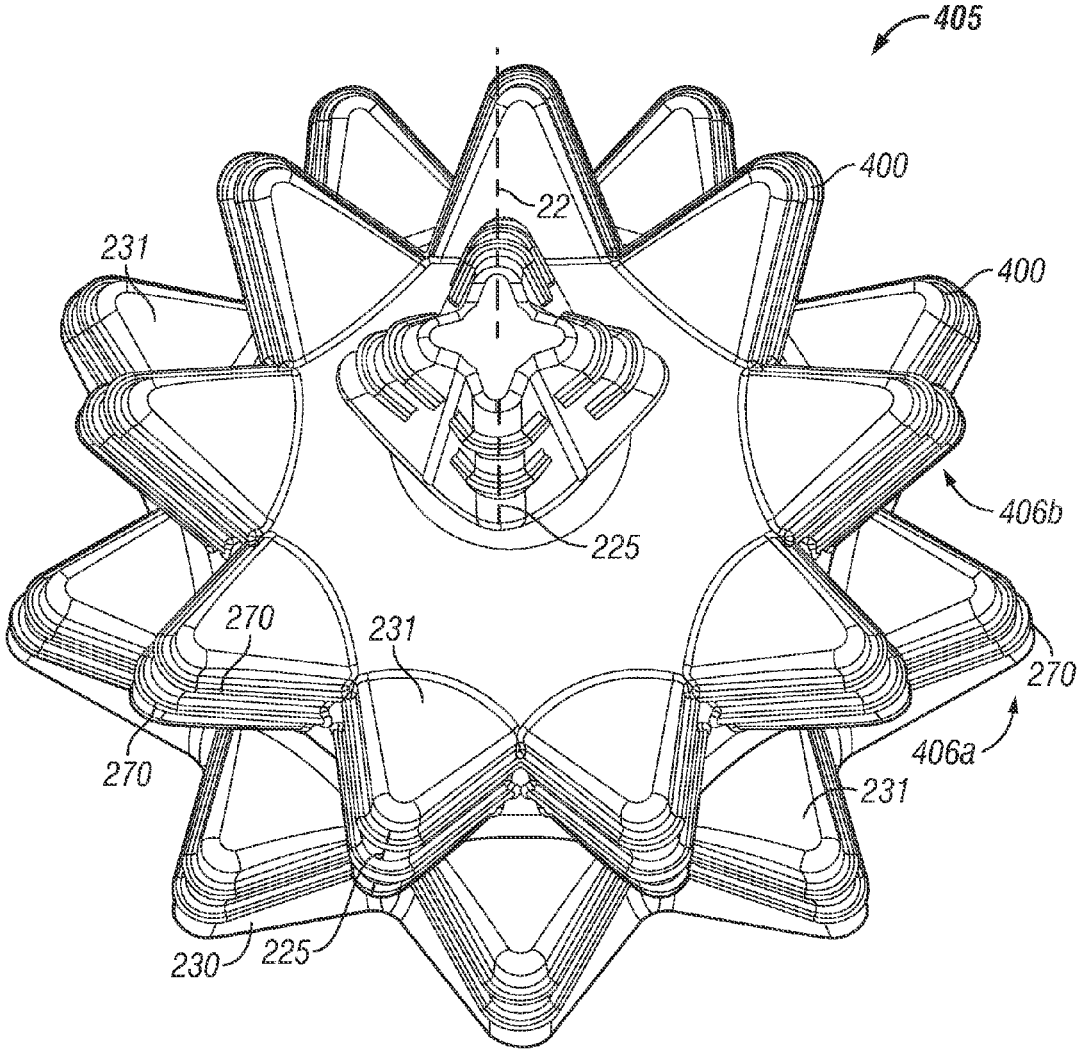
FIG. 10 is a perspective view of a rolling cone cutter having the cutting tooth of FIGS. 9*a*-9*c* mounted therein.

Referring now to FIG. 10, tooth 400 described above is shown mounted in a rolling cone cutter 405 as may be employed, for example, in bit 10 described above with reference to FIGS. 1 and 2, with cone cutter 405 substituted for any of the cones 1-3 previously described. As shown, cone cutter 405 includes a plurality of teeth 400 disposed in a circumferential gage row 406*a* and a plurality of teeth 400 disposed in a circumferential inner row 406*b*. In this embodiment, teeth 400 are all oriented such that a projection of crest median line 225 is aligned with cone axis 22. However, in other embodiments, teeth 400 may be mounted in other orientations, such as in an orientation where a projection of the crest median line 225 of one or more teeth 400 is skewed relative to the cone axis.

Figure 11A:
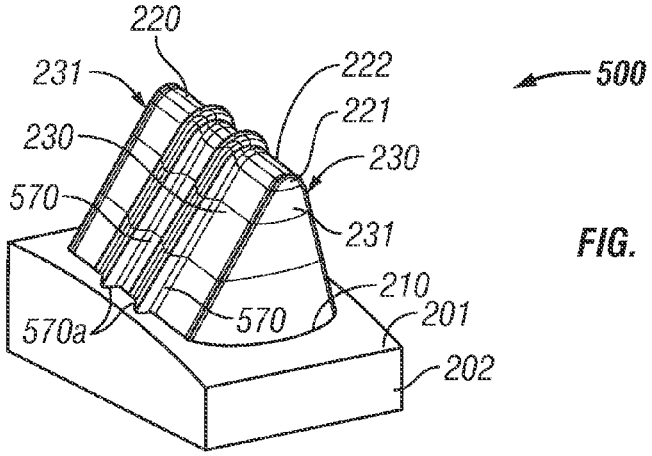
FIG. 11*a* is a perspective view of an embodiment of a cutting tooth having particular application in a rolling cutter bit such as that shown in FIGS. 1 and 2.
Figure 11B:
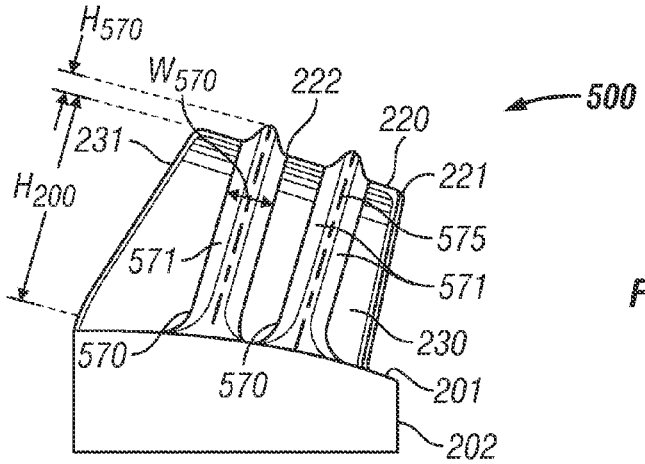
FIG. 11*b* is a side view of the cutting tooth of FIG. 11*a;*
Figure 11C:
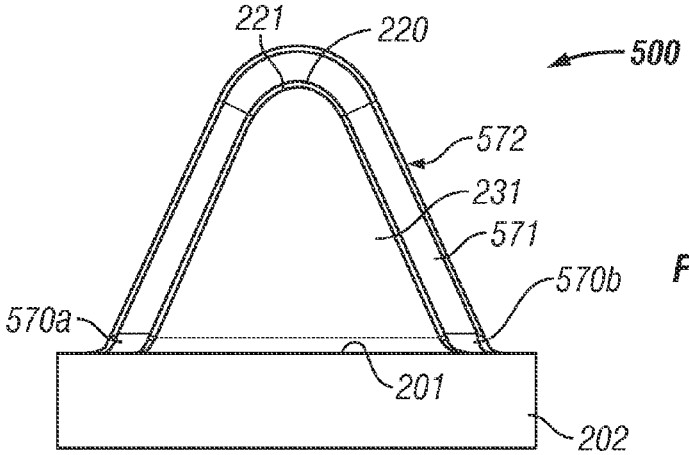
FIG. 11*c* is an end view of the cutting tooth of FIG. 11*a;*

Referring now to FIGS. 11*a*-11*c*, an embodiment of a cutting element or tooth 500 believed to have particular utility when employed in a rolling cutter tooth bit, such as in gage row 61*a* or inner row 61*b* shown in FIGS. 1-3 above, is shown. However, it should be appreciated that tooth 400 may also be employed in other rows and other regions on the rolling cone cutter. In FIGS. 11*a*-11*c*, tooth 500 is shown extending from the surface 201 of a rolling cone cutter 202.

Tooth 500 is substantially the same as tooth 400 previously described. Namely, tooth 500 is generally wedge-shaped and has a base 210 monolithically formed with cutter 202, an elongate chisel crest 220 distal base 210, a pair of flanking surfaces 230, and a pair of end surfaces 231, each as previously described. In addition, tooth 500 includes two ribs 570, each similar to rib 270 previously described. Namely, each rib 570 extends continuously along each flanking surface 230 and across crest 220. In particular, each rib 570 extends along a longitudinal axis 575 from a first end 570*a* on one flanking surface 230 at cone surface 201 to a second end 570*b* on the other flanking surface 230 at cone surface 201. Longitudinal axis 575 of each rib 570 is oriented perpendicular to crest median line 225 and apex 222 on both flanking surfaces 230 and extends linearly from crest 220 to each end 570*a, b*. As with tooth 400 previously described, in this embodiment, the two ribs 570 are evenly distributed across crest 220. In other words, each rib 570 is spaced one-third the length $L_{220}$ of crest 220 from different crest ends 221, and ribs 570 are spaced one-third the length $L_{220}$ of crest 220 from each other.

As best shown in FIG. 11*b*, rib 570 is formed by a pair of flanking surfaces 571 that taper or incline towards each other as they extend from flanking surfaces 230 and crest 220 to a peak 572. However, in this embodiment, peak 572 is relatively blunt compared to peak 272 of rib 270 previously described. In particular, peak 272 has a radius of curvature that is 20% the radius of curvature $R_{220}$ of crest 220, whereas peak 572 of each rib 570 has a radius of curvature that is 40% of the radius of curvature $R_{220}$ of crest 220. In general, the smaller the radius of curvature of the peak of the rib (e.g., peak 272 of rib 270, peak 572 of rib 570), the "sharper" and more aggressive the rib. Likewise, the smaller the radius of curvature of the crest (e.g., radius of curvature $R_{220}$ of crest 220), the "sharper" and more aggressive the crest. Still further, in this embodiment, the transition of each flanking surface 571 to surface 230 and crest 220 is smoothly curved and concave.

In this embodiment, each rib 570 is identical, and each rib 570 has a uniform geometry along its entire length. Specifically, each rib 570 extends to the same height $H_{570}$ measured perpendicularly from either flanking surface 230 or crest 220 to peak 572. The height $H_{570}$ of each rib 570 is preferably 10-20% of the height $H_{200}$ of tooth 200. In this embodiment, the height $H_{570}$ of each rib 570 is 15% of the height $H_{200}$ of tooth 200 at the lengthwise center of apex 222 (i.e., at the midpoint of apex 222 relative to crest ends 221). In addition, each rib 570 has a width $W_{570}$ measured perpendicular to axis 575 (in side view) between surfaces 571. Since surfaces 571 are inclined towards each other, width $W_{570}$ of each rib 570 is maximum at the intersection of rib 570 with flanking surfaces 230 and crest 220, and minimum at peak 572. In this embodiment, each rib 570 has the same maximum and minimum width $W_{570}$. The maximum width $W_{570}$ of each rib 570 is preferably 15-35% the length $L_{220}$ of crest 220, and more preferably 20-30% the length $L_{220}$ of crest 220.

Although this embodiment of tooth 500 includes only two ribs 570, in other embodiments, more than two ribs 570 may be provided. Further, the ribs (e.g., ribs 570) may be uniformly or non-uniformly distributed relative to the crest ends (e.g., crest ends 221). Further, in other embodiments, one or more rib(s) (e.g., ribs 570) may extend perpendicularly or at an acute angle from the crest (e.g., crest 220) in side view, one or more rib(s) may extend from the crest along one or both of the flanking surfaces, one or more rib(s) may extend from the crest to the cone surface or terminate short of the cone surface, or combinations thereof. Moreover, although the geometry of each rib 570 is the same and is uniform along its entire length, in other embodiments, the height of each rib (e.g., height $H_{570}$ of each rib 570), the maximum width of each rib (e.g., width $W_{570}$ at surfaces 230 and crest 222), the minimum width of each rib (e.g., width $W_{570}$ at peak 572), or combinations thereof may be different and/or vary along each rib's length.

Figure 12:
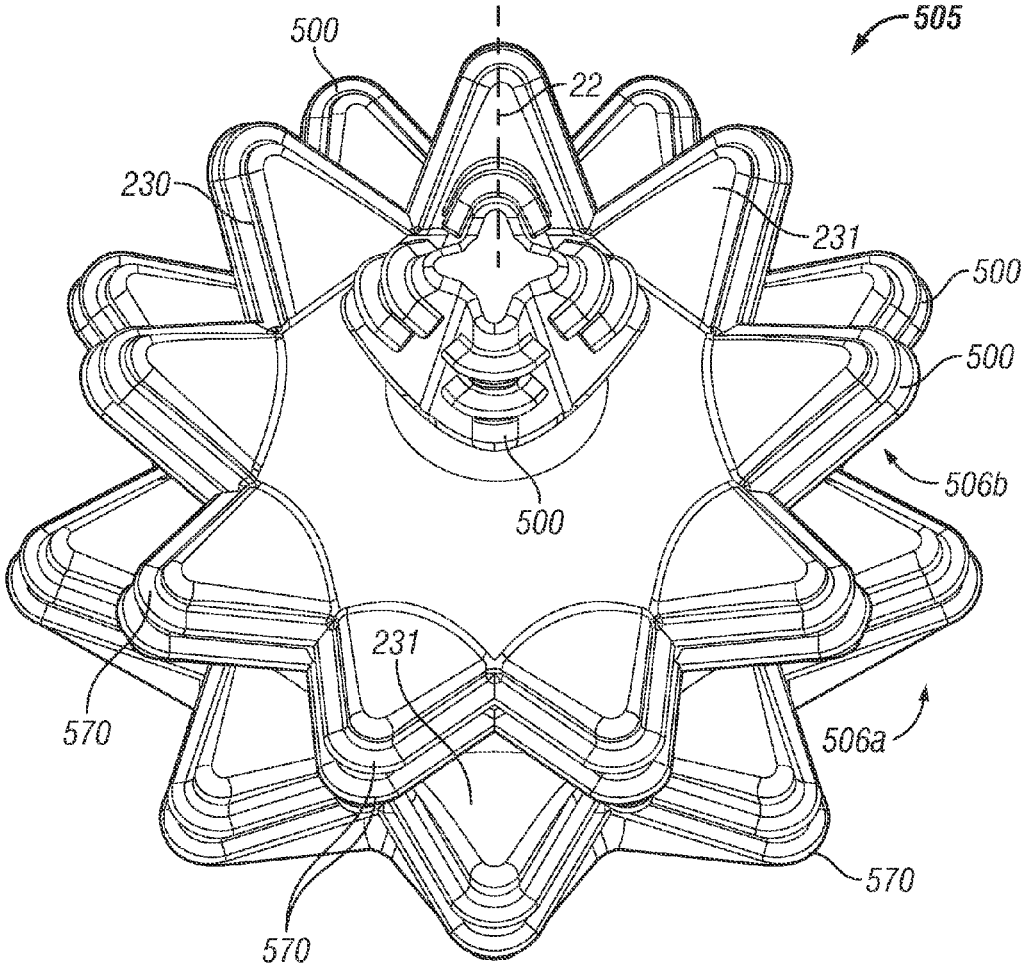
FIG. 12 is a perspective view of a rolling cone cutter having the cutting tooth of FIGS. 11*a*-11*c* mounted therein.

Referring now to FIG. 12, tooth 500 described above is shown mounted in a rolling cone cutter 505 as may be employed, for example, in bit 10 described above with reference to FIGS. 1 and 2, with cone cutter 505 substituted for any of the cones 1-3 previously described. As shown, cone cutter 505 includes a plurality of teeth 500 disposed in a circumferential gage row 506*a* and a plurality of teeth 500 disposed in a circumferential inner row 506*b*. In this embodiment, teeth 500 are all oriented such that a projection of crest median line 225 is aligned with cone axis 22. However, in other embodiments, teeth 500 may be mounted in other orientations, such as in an orientation where a projection of the crest median line 225 of one or more teeth 500 is skewed relative to the cone axis.

As understood by those skilled in the art, the phenomenon by which formation material is removed by the impact of cutting teeth is extremely complex. A variety of factors including, without limitation, the geometry and orientation of the cutting teeth, the design of the rolling cone cutters, and the type of formation being drilled, all play a role in how the formation material is removed and the rate that the material is removed (i.e., ROP).

Depending upon their position in the rolling cone cutter, cutting teeth have different cutting trajectories as the cone rotates in the borehole. Cutting teeth in certain locations of the cone cutter have more than one cutting mode. In addition to a scraping or gouging motion, some cutting teeth include a twisting motion as they enter into and then separate from the formation. Accordingly, such teeth may be oriented to optimize the cutting and formation removal that takes place as the cutter element both scrapes and twists against the formation. Furthermore, as mentioned above, the type of formation material dramatically impacts a given bit's ROP. In relatively brittle formations, a given impact by a particular cutting tooth may remove more rock material than it would in a less brittle or a plastic formation.

The impact of a cutting tooth with the formation will typically remove a first volume of formation material and, in addition, will tend to generate cracks in the formation immediately adjacent the material that has been removed. These cracks, in turn, allow for the easier removal of the now-fractured material by the subsequent impact from other cutting teeth on the bit. Without being limited to this or any other particular theory, it is believed that cutting teeth 200, 300, 400, 500 having an elongate chisel crest 220 and one or more raised ribs 270, 370, 570, as described above, will enhance formation removal by propagating cracks further into the uncut formation than would be the case for a conventional chisel-shaped cutting tooth (e.g., tooth 100) of similar size. In particular, it is anticipated that providing ribs 270, 370, 570 extending from apex 222 will provide insert 100 with the ability to penetrate deeply into the formation without the requirement of adding substantial additional weight-on-bit to achieve that penetration. Since ribs 270, 370, 570 extend from crest 220, they will generally lead teeth 200, 300, 400, 500 into the formation. As ribs 270, 370, 570 penetrate the formation, it is anticipated that substantial cracking will occur, allowing crest 220 to gouge and scrape away a substantial volume of formation material as it sweeps across (and in some cone positions, twists through) the formation material. Further, since ribs 270, 370, 570 extend from apex 222 of crest 220, and thus, are able to penetrate deeper into the formation as compared to a similarly-sized conventional chisel-shaped cutting teeth, it is believed that each tooth 200, 300, 400, 500 will create deeper cracks in a localized area, allowing the remainder of tooth 200, 300, 400, 500, and the cutting teeth that follow thereafter, to remove formation material at a faster rate. Further, as previously described, each rib 270, 370, 570 extends from crest 220 down each flanking surface 220. Consequently, the increased "sharpness" and penetrating potential of each tooth 200, 300, 400, 500 provided by each rib 270, 370, 570 at apex 222 is buttressed and supported by increased insert material.

Figure 13A:
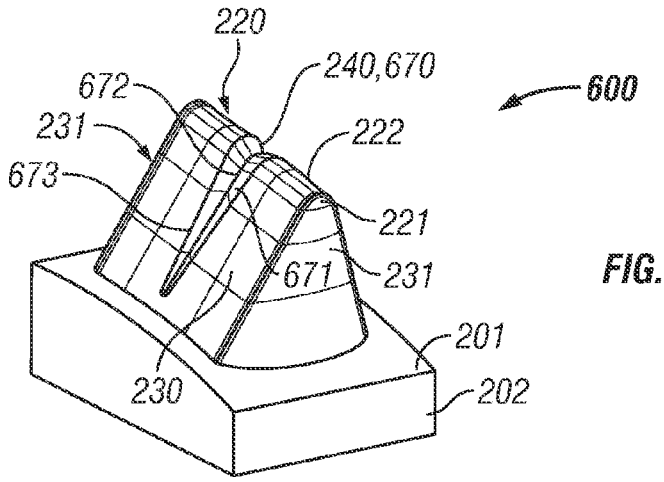
FIG. 13*a* is a perspective view of an embodiment of a cutting tooth having particular application in a rolling cutter bit such as that shown in FIGS. 1 and 2.
Figure 13B:
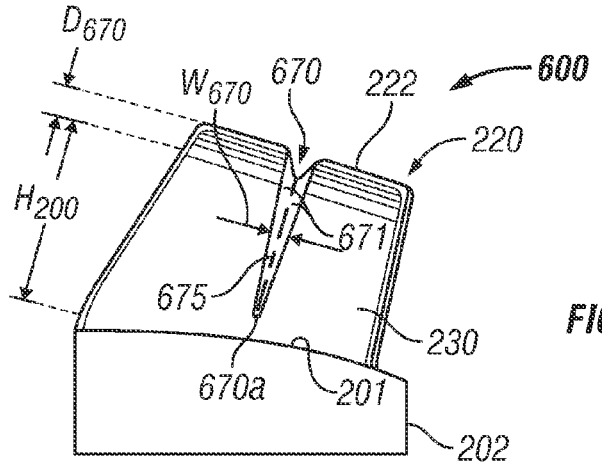
FIG. 13*b* is a side view of the cutting tooth of FIG. 13*a;*
Figure 13C:
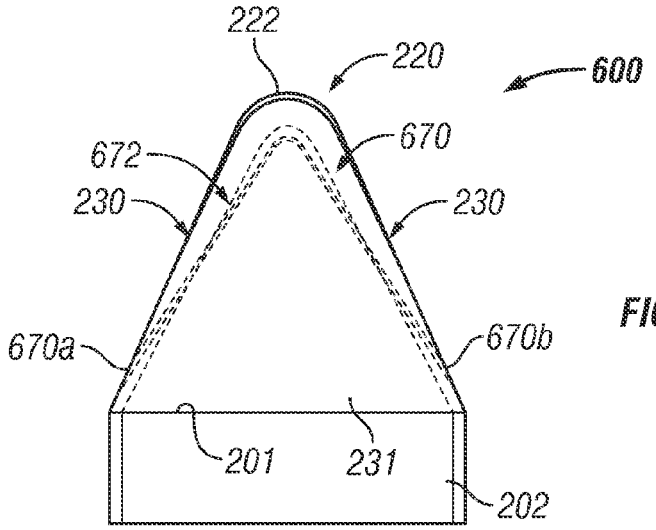
FIG. 13*c* is an end view of the cutting tooth of FIG. 13*a;*

Referring now to FIGS. 13*a*-13*c*, an embodiment of a cutting element or tooth 600 believed to have particular utility when employed in a rolling cutter tooth bit, such as in gage row 61*a* or inner row 61*b* shown in FIGS. 1-3 above, is shown. However, it should be appreciated that tooth 600 may also be employed in other rows and other regions on the rolling cone cutter. In FIGS. 13*a*-13*c*, tooth 600 is shown extending from the surface 201 of a rolling cone cutter 202.

Tooth 600 is similar to tooth 200 previously described. Namely, tooth 600 is generally wedge-shaped and has a base 210 monolithically formed with cutter 202, an elongate chisel crest 220 distal base 210, a pair of flanking surfaces 230, and a pair of end surfaces 231, each as previously described. In addition, tooth 600 includes a discontinuity 240 extending along each flanking surface 230 and across crest 220. However, unlike tooth 200 in which discontinuity 240 comprises raised rib 270, in this embodiment, discontinuity 240 comprises a generally concave groove 670.

Groove 670 extends continuously along each flanking surface 230 and across crest 220. In particular, groove 670 extends along a longitudinal axis 675 from a first end 670*a* on one flanking surface 230 proximal cone surface 201 to a second end 670*b* on the other flanking surface 230 proximal cone surface 201. As best shown in the side view of FIG. 13*b*, in this embodiment, longitudinal axis 675 is oriented perpendicular to crest median line 225 and apex 222 on both flanking surfaces 230, extends linearly from crest 220 to each end 670*a, b*, and is centered on crest 220 relative to crest ends 221. In this embodiment, each end 670*a, b* is proximal, but spaced apart from cone surface 201. In other words, groove 670 does not extend to cone surface 201 on either flanking surface 230. In other embodiments, multiple grooves (e.g., ribs 670) may be provided, one or more groove(s) may be disposed at the center of the crest (e.g., crest 220) or offset from the center of the crest, one or more groove(s) may extend perpendicularly or at an acute angle from the crest in side view, one or more groove(s) may extend from the crest along one or both of the flanking surfaces, one or more groove(s) may extend from the crest to the cone surface or terminate short of the cone surface, or combinations thereof.

As best shown in FIG. 13*b*, groove 670 is formed by a pair of surfaces 671 that taper or incline towards each other as they extend into flanking surfaces 230 and crest 220 to a valley 672. Edges 673 are formed at the intersection of groove 670 with flanking surfaces 230 and crest 220. In this embodiment, edges 673 are radiused to reduce stress concentrations. Edges 673 provide additional cutting edges for engagement with the formation when crest 220 impacts the formation during drilling. Groove 670 extends inward relative to flanking surfaces 230 and crest 220 to a depth $D_{670}$ measured perpendicularly from either flanking surface 230 or crest 220 to valley 672. In this embodiment, the depth $D_{670}$ of groove 670 is maximum at crest 220, and decreases linearly moving from crest 220 down flanking surfaces 230 toward ends 670*a, b*. The maximum depth $D_{670}$ of groove at crest 220 is preferably 5-25% of the height $H_{200}$ of tooth 600 at the lengthwise center of apex 222 (i.e., at the midpoint of apex 222 relative to crest ends 221), and more preferably 10-20% of the height $H_{200}$ of tooth 600 at the lengthwise center of apex 222 (i.e., at the midpoint of apex 222 relative to crest ends 221). In this embodiment, depth $D_{670}$ is 15% of the height $H_{200}$ of tooth 600 at the lengthwise center of apex 222 (i.e., at the midpoint of apex 222 relative to crest ends 221). In addition, groove 670 has a width $W_{670}$ measured perpendicular to axis 675 (in side view) between surfaces 671. Since surfaces 671 are inclined towards each other, width $W_{670}$ decreases moving inward from edges 673 toward valley 672. In this embodiment, width $W_{670}$ of groove 670 at edges 673 is maximum at apex 222 and decreases moving from crest 220 to each end 670*a, b*. At apex 222, width $W_{670}$ of groove 670 is preferably 10-30% of the length $L_{220}$ of crest 220, and more preferably 15-25% of the length $L_{220}$ of crest 220. In this embodiment, width $W_{670}$ between edges 673 at apex 222 is 20% of the length $L_{220}$ of crest 220. In this embodiment, groove 670 is generally triangular, however, the height $H_{670}$ and width $W_{670}$ of groove 670 vary moving from crest 220 to ends 670*a, b* as previously described. In other embodiments, the geometry of the groove (e.g., groove 670) may be uniform along its entire length or portions thereof.

Figure 14:
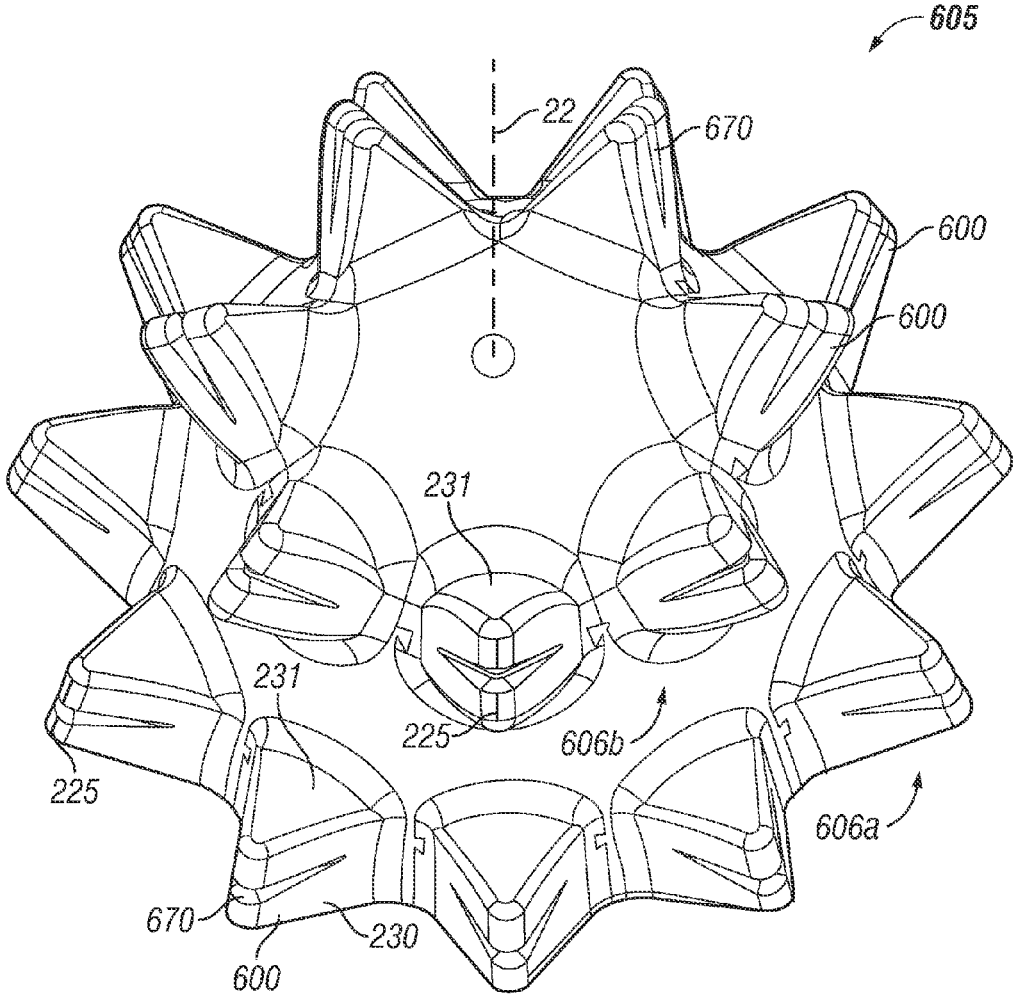
FIG. 14 is a perspective view of a rolling cone cutter having the cutting tooth of FIGS. 13*a*-13*c* mounted therein.

Referring now to FIG. 14, tooth 600 described above is shown mounted in a rolling cone cutter 605 as may be employed, for example, in bit 10 described above with reference to FIGS. 1 and 2, with cone cutter 605 substituted for any of the cones 1-3 previously described. As shown, cone cutter 605 includes a plurality of teeth 600 disposed in a circumferential gage row 606*a* and a plurality of teeth 600 disposed in a circumferential inner row 606*b*. In this embodiment, teeth 600 are all oriented such that a projection of crest median line 225 is aligned with cone axis 22. However, in other embodiments, teeth 600 may be mounted in other orientations, such as in an orientation where a projection of the crest median line 225 of one or more teeth 200 is skewed relative to the cone axis.

Figure 15A:
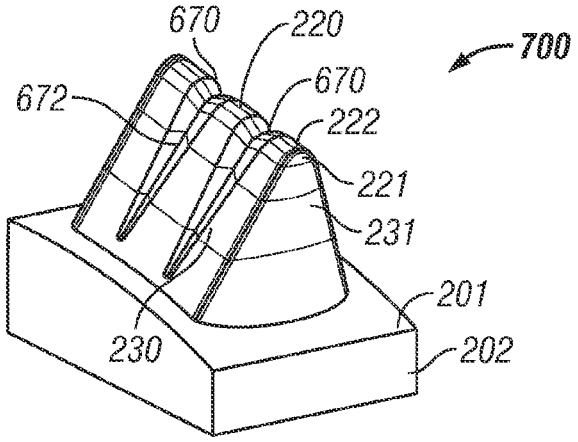
FIG. 15*a* is a perspective view of an embodiment of a cutting tooth having particular application in a rolling cutter bit such as that shown in FIGS. 1 and 2.
Figure 15B:
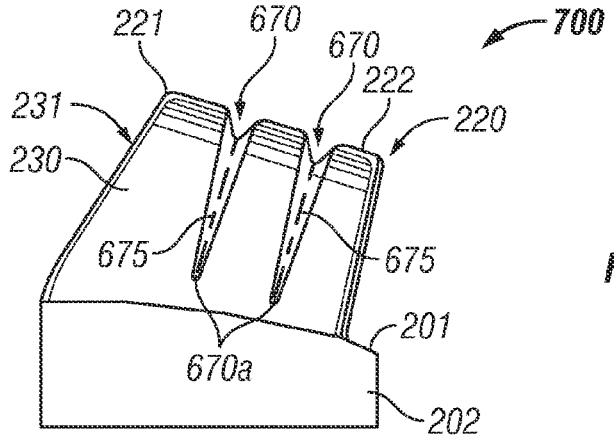
FIG. 15*b* is a side view of the cutting tooth of FIG. 15*a;*
Figure 15C:
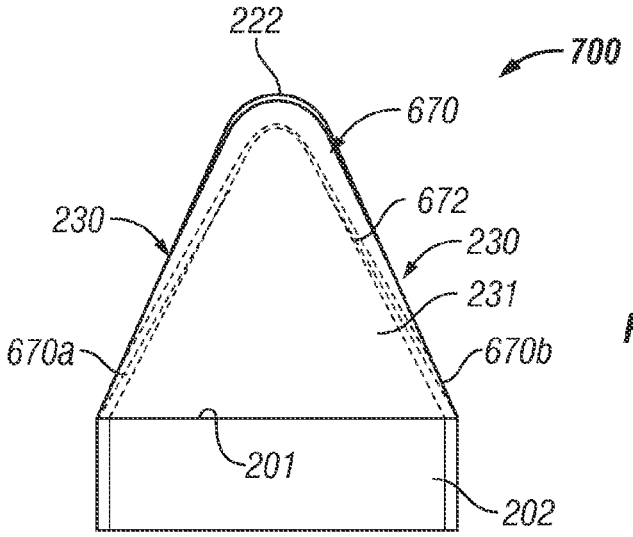
FIG. 15*c* is an end view of the cutting tooth of FIG. 15*a;*

Referring now to FIGS. 15*a*-15*c*, an embodiment of a cutting element or tooth 700 believed to have particular utility when employed in a rolling cutter tooth bit, such as in gage row 61*a* or inner row 61*b* shown in FIGS. 1-3 above, is shown. However, it should be appreciated that tooth 700 may also be employed in other rows and other regions on the rolling cone cutter. In FIGS. 9*a*-9*c*, tooth 700 is shown extending from the surface 201 of a rolling cone cutter 202.

Tooth 700 is substantially the same as tooth 600 previously described. Namely, tooth 700 is generally wedge-shaped and has a base 210 monolithically formed with cutter 202, an elongate chisel crest 220 distal base 210, a pair of flanking surfaces 230, and a pair of end surfaces 231, each as previously described. However, unlike tooth 600 that includes only one groove 670, in this embodiment, tooth 700 includes two grooves 670, each as previously described. As best shown in FIG. 15*b*, each groove 670 is oriented perpendicular to crest median line 225 and apex 222, and extends linearly from crest 220 down each flanking surface 230. However, in this embodiment, neither groove 670 is centered on crest 220 relative to crest ends 221. Instead, grooves 670 are uniformly distributed across crest 220—median line 675 of one groove 670 is spaced one-third (⅓) the crest length $L_{220}$ from one crest end 221, median line 675 of the other groove 670 is spaced one-third (⅓) the crest length $L_{220}$ from the other crest end 221, and the median lines 675 of grooves 670 are spaced apart one-third (⅓) the crest length $L_{220}$. Although neither groove 670 is centered on crest 220, and grooves 670 are uniformly distributed across crest 220 in this embodiment, in other embodiments including multiple grooves (e.g., grooves 670), one groove may be centered on the crest (e.g., crest 220) and/or the grooves may be non-uniformly distributed along the crest relative to the crest ends (e.g., crest ends 221).

Figure 16:
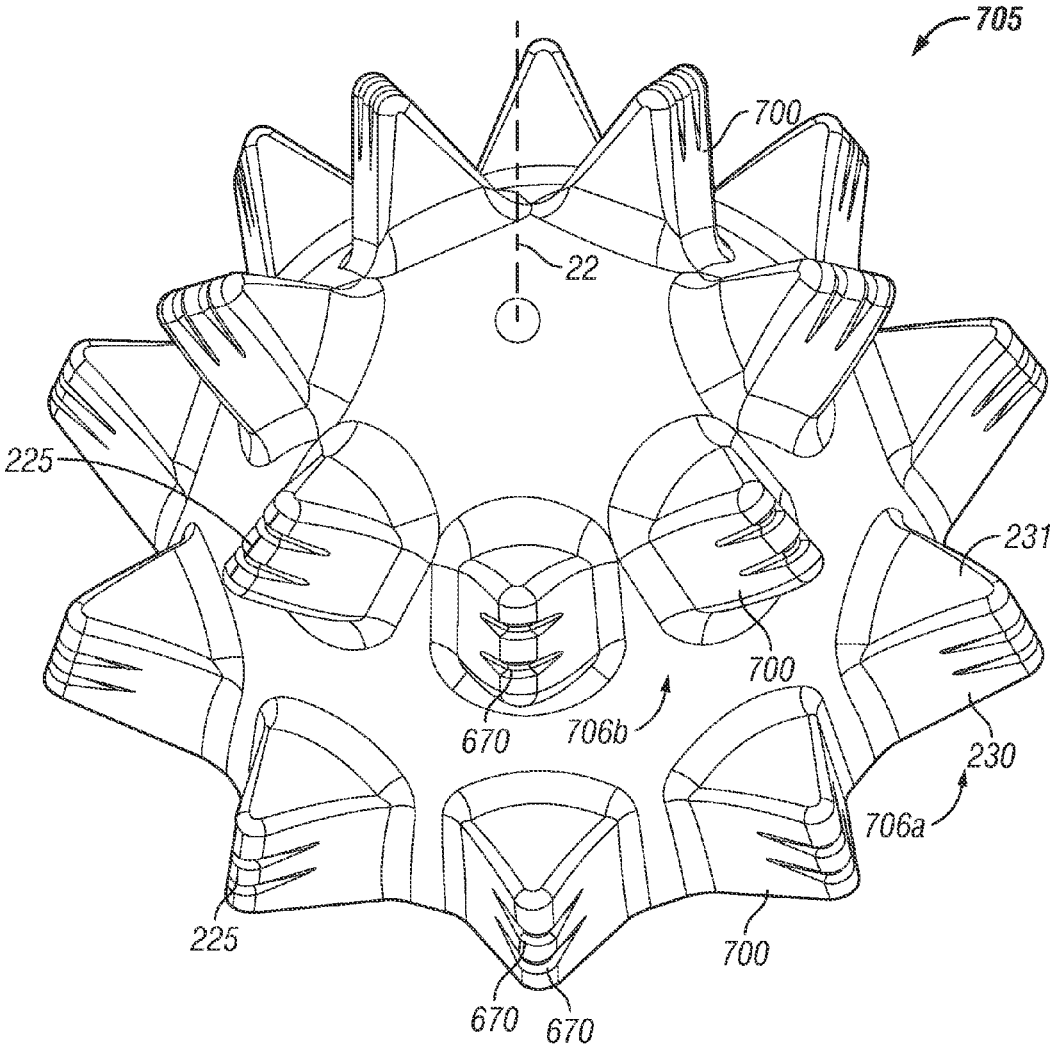
FIG. 16 is a perspective view of a rolling cone cutter having the cutting tooth of FIGS. 15*a*-15*c* mounted therein.

Referring now to FIG. 16, tooth 700 described above is shown mounted in a rolling cone cutter 705 as may be employed, for example, in bit 10 described above with reference to FIGS. 1 and 2, with cone cutter 705 substituted for any of the cones 1-3 previously described. As shown, cone cutter 705 includes a plurality of teeth 700 disposed in a circumferential gage row 706*a* and a plurality of teeth 700 disposed in a circumferential inner row 706*b*. In this embodiment, teeth 700 are all oriented such that a projection of crest median line 225 is aligned with cone axis 22. However, in other embodiments, teeth 700 may be mounted in other orientations, such as in an orientation where a projection of the crest median line 225 of one or more teeth 700 is skewed relative to the cone axis.

As previously described, the phenomenon by which formation material is removed by the impact of cutting teeth is extremely complex. A variety of factors including, without limitation, the geometry and orientation of the cutting teeth, the design of the rolling cone cutters, and the type of formation being drilled, all play a role in how the formation material is removed and the rate that the material is removed (i.e., ROP). Without being limited to this or any other particular theory, it is believed that cutting teeth 600, 700 having an elongate chisel crest 220 with one or more grooves 670 as described above, may enhance formation removal in certain applications by enhancing the formation of cracks in the uncut formation as compared to a conventional chisel-shaped cutting tooth (e.g., tooth 100) of similar size. In particular, it is anticipated that the additional cutting edges 673 on crest 220 formed by grooves 670 will enhance crack formation and propagation without the requirement of adding substantial additional weight-on-bit, allowing crest 220 to gouge and scrape away a substantial volume of formation material as it sweeps across (and in some cone positions, twists through) the formation material.

Figure 17A:
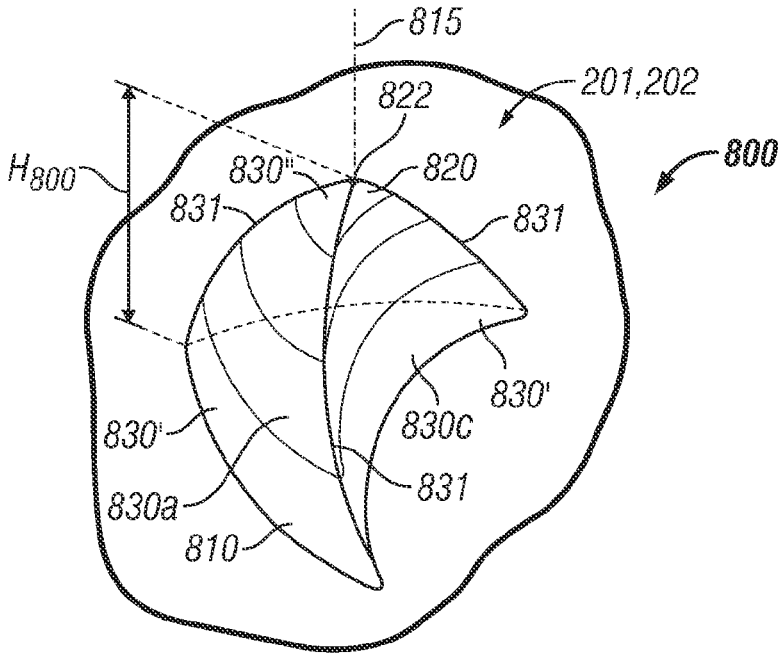
FIG. 17*a* is a perspective view of an embodiment of a cutting tooth having particular application in a rolling cutter bit such as that shown in FIGS. 1 and 2.
Figure 17B:
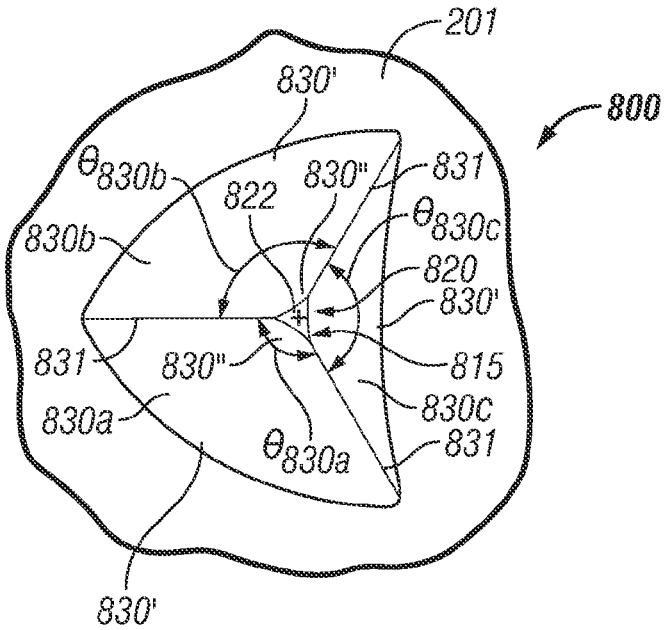
FIG. 17*b* is a top view of the cutting tooth of FIG. 17*a;*

Referring now to FIGS. 17*a* and 17*b*, an embodiment of a cutting element or tooth 800 believed to have particular utility when employed in a rolling cutter tooth bit, such as in gage row 61*a* or inner row 61*b* shown in FIGS. 1-3 above, is shown. However, it should be appreciated that tooth 800 may also be employed in other rows and other regions on the rolling cone cutter. In FIGS. 17*a* and 17*b*, tooth 800 is shown extending from the surface 201 of a rolling cone cutter 202.

Tooth 800 has base 810 monolithically formed with cutter 202, and a pointed cutting tip 820 distal base 810. Tip 820 defines an apex 822 of tooth 800. The central axis 815 of tooth 800 extends perpendicularly from base 210 (i.e., perpendicular to a projection of the cone surface 201 beneath tooth 800) through apex 822. Apex 822 is disposed at height $H_{800}$ measured perpendicularly from the cone surface to apex 822. In this embodiment, tooth 800 is generally pyramid-shaped, including a plurality of generally triangular flanking surfaces 830*a, b, c* that taper or incline towards one another as they extend from base 810 to tip 820. In particular, three flanking surfaces 830*a, b, c* are provided, with each flanking surface 830*a, b, c* extending between the other two flanking surfaces 830*a, b, c*. Thus, as best shown in FIG. 17*b*, base 810 is generally trilateral or three-sided. An edge 831 is formed at the intersection of each pair of adjacent flanking surfaces 830. Although referred to as an "edge," the intersection between flanking surfaces 830 may be radius or rounded to reduce stress concentrations.

Referring still to FIGS. 17*a* and 17*b*, each flanking surface 830 has a first or base end 830' at base 210, and a second or tip end 830". Together, ends 830" define tip 820. As best shown in FIG. 17*b*, in this embodiment, two flanking surfaces 830*a, b* are convex or outwardly bowed and one flanking surface 830*c* is concave or inwardly bowed. In particular, surface 830*a* is convex between adjacent surfaces 830*b, c*, surface 830*b* is convex between adjacent surfaces 830*a, c*, and surface 830*c* is concave between surfaces 830*a, b*.

Referring specifically to FIG. 17*b*, in top view, convex flanking surface 830*a* extends through an angular distance $\theta_{830a}$ about axis 815, convex flanking surface 830*b* extends through an angular distance $\theta_{830b}$ about axis 815, and concave flanking surface 830*c* extends through an angular distance $\theta_{830c}$ about axis 815. In this embodiment, angle $\theta_{830a}$ and angle $\theta_{830b}$ are the same, each being less than angle $\theta_{830c}$. In particular, angles $\theta_{830a}$, $\theta_{830b}$ are 130°, and angle $\theta_{830c}$ is 100°. In other embodiments, angles $\theta_{830a}$, $\theta_{830b}$, $\theta_{830c}$ may be different, but are preferably each between 100° and 130°.

Figure 18:
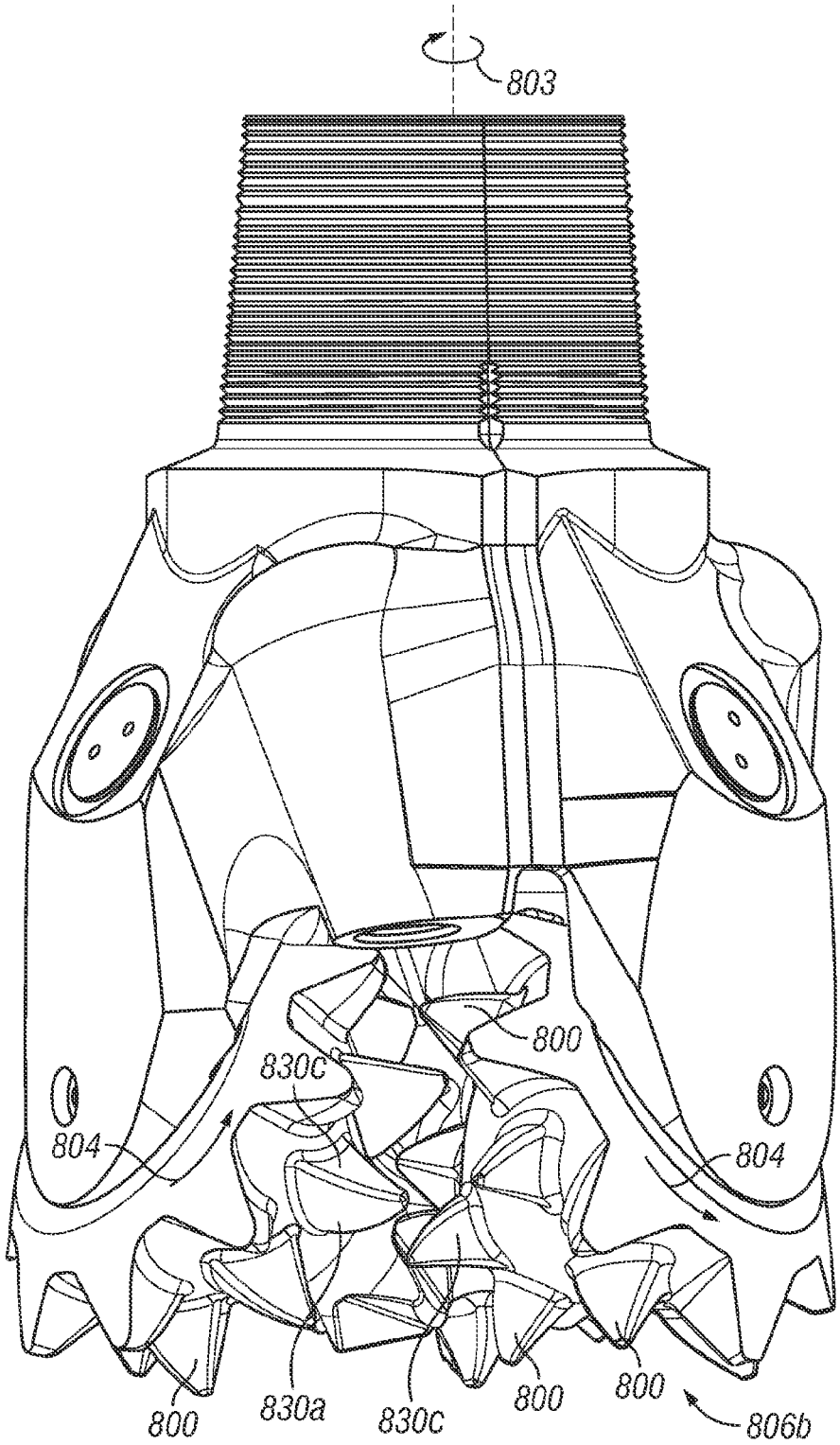
FIG. 18 is a perspective view of a rolling cone bit having the cutting tooth of FIGS. 17*a*-17*c* mounted therein.

Referring now to FIG. 18, tooth 800 described above is shown mounted in rolling cone cutters 805 of a rolling cone drill bit 806. As shown, each cone cutter 805 includes a plurality of teeth 800 disposed in a circumferential inner row 806*b*. During drilling, bit 806 rotates about the bit axis in a direction represented by arrow 803, and each cone cutter 805 rotates about a cone axis in a direction represented by arrows 804. Relative to the direction of arrows 803, one-half of each tooth 800 facing the direction of rotation 803 of its respective cone cutter 805 may be described as "leading" as it leads the tooth 800 into the formation during drilling, and the opposite half of each tooth 800 facing away from the direction of rotation 803 of its respective cone cutter 805 may be described as "trailing" as it trails or follows the leading portion of the tooth 800 into the formation during drilling. In this embodiment, each tooth 800 is oriented such that concave flanking surface 830*c* is disposed on the leading side of the tooth 800, and convex flanking surfaces 830*a, b* are disposed on the trailing side of the tooth 800. However, in other embodiments, one or more teeth 800 may be mounted in other orientations, such as in an orientation where concave flanking surface 830*c* and one convex flanking surface 830*a* or 830*b* are sharing the leading side.

Figure 19A:
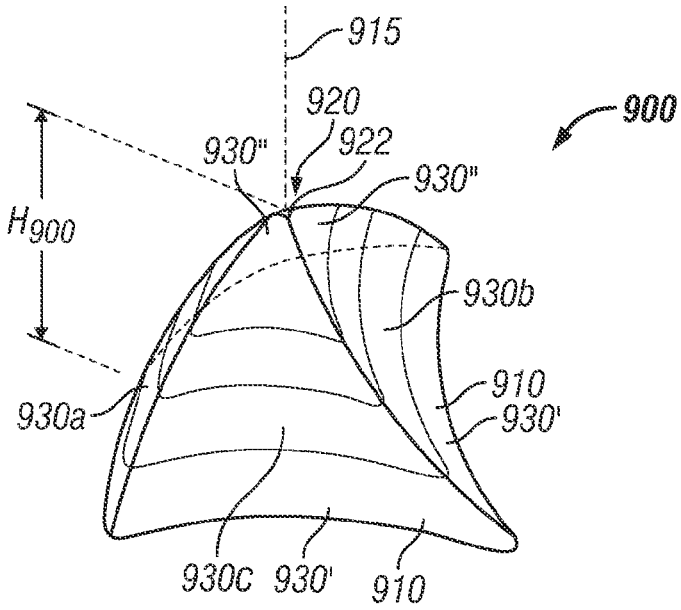
FIG. 19*a* is a perspective view of an embodiment of a cutting tooth having particular application in a rolling cutter bit such as that shown in FIGS. 1 and 2.
Figure 19B:
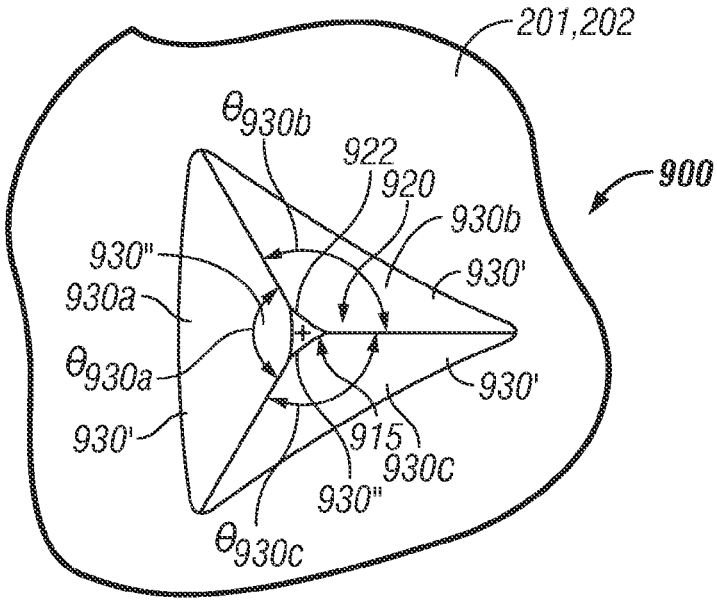
FIG. 19*b* is a top view of the cutting tooth of FIG. 19*a;*

Referring now to FIGS. 19*a* and 19*b*, an embodiment of a cutting element or tooth 900 believed to have particular utility when employed in a rolling cutter tooth bit, such as in gage row 61*a* or inner row 61*b* shown in FIGS. 1-3 above, is shown. However, it should be appreciated that tooth 900 may also be employed in other rows and other regions on the rolling cone cutter. In FIGS. 19*a* and 19*b*, tooth 900 is shown extending from the surface 201 of a rolling cone cutter 202.

Tooth 900 is similar to tooth 800 previously described. Namely, tooth 900 has a base 910 monolithically formed with cutter 202 and a pointed cutting tip 920 distal base 910. Tip 920 defines an apex 922 of tooth 900. The central axis 915 of tooth 900 extends perpendicularly from base 210 (i.e., perpendicular to a projection of the cone surface 201 beneath tooth 900) through apex 922. Apex 922 is disposed at height $H_{900}$ measured perpendicularly from the cone surface to apex 922. In addition, tooth 900 is generally pyramid-shaped, including a plurality of generally triangular flanking surfaces 930*a, b, c* that taper or incline towards one another as they extend from base 910 to tip 920. In particular, three flanking surfaces 930*a, b, c* are provided, with each flanking surface 930*a, b, c* extending between the other two flanking surfaces 930*a, b, c*. Thus, as best shown in FIG. 19*b*, base 910 is generally trilateral or three-sided. An edge 931 is formed at the intersection of each pair of adjacent flanking surfaces 930*a, b, c*. Although referred to as an "edge," the intersection between flanking surfaces 930*a, b, c* may be radius or rounded to reduce stress concentrations. Each flanking surface 930*a, b, c* has a first or base end 930' at base 210, and a second or tip end 930". Together, ends 930" define tip 820. However, unlike tooth 800 previously described, which includes two convex flanking surfaces 830*a, b* and one concave flanking surface 830*c*, in this embodiment, one flanking surface 930*a* is convex or outwardly bowed between the adjacent surfaces 930*b, c*, and the remaining two flanking surfaces 930*b, c* are concave or inwardly bowed between the adjacent surfaces 930*a, c* and 930*a, b*, respectively.

Referring specifically to FIG. 19*b*, in top view, convex flanking surface 930*a* extends through an angular distance $\theta_{930a}$ about axis 915, concave flanking surface 930*b* extends through an angular distance $\theta_{930b}$ about axis 915, and concave flanking surface 930*c* extends through an angular distance $\theta_{930c}$ about axis 915. In this embodiment, angles $\theta_{930a}$, $\theta_{930b}$, $\theta_{930c}$ are the same, each being about 120°. In other embodiments, angles $\theta_{930a}$, $\theta_{930b}$, $\theta_{930c}$ may be different, but are preferably each between 100° and 130°.

Figure 20:
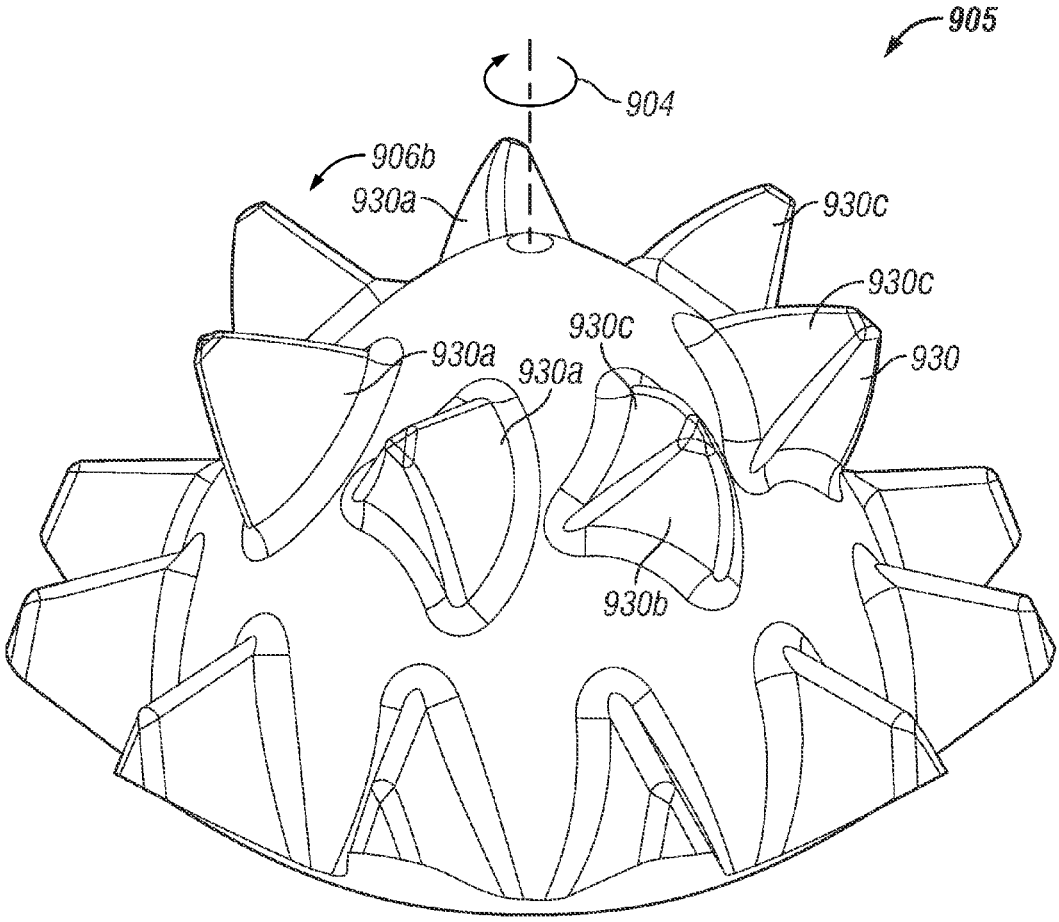
FIG. 20 is a perspective view of a rolling cone cutter having the cutting tooth of FIGS. 19*a*-19*c* mounted therein.

Referring now to FIG. 20, tooth 900 described above is shown mounted in a rolling cone cutter 905 as may be employed, for example, in bit 10 described above with reference to FIGS. 1 and 2, with cone cutter 905 substituted for any of the cones 1-3 previously described. As shown, cone cutter 905 includes a plurality of teeth 900 disposed in a circumferential inner row 906*b*. During drilling, cone cutter 905 rotates about a cone axis in a direction represented by arrows 904. Relative to the direction of arrow 904, one-half of each tooth 900 facing the direction of rotation 904 of cone cutter 905 may be described as "leading" as it leads the tooth 900 into the formation during drilling, and the opposite half of each tooth 900 facing away from the direction of rotation 904 of cone cutter 905 may be described as "trailing" as it trails or follows the leading portion of the tooth 900 into the formation during drilling. In this embodiment, each tooth 900 is oriented such that concave flanking surfaces 930*b, c* are disposed on the leading side of the tooth 900, and convex flanking surfaces 930*a* is disposed on the trailing side of the tooth 900. However, in other embodiments, one or more teeth 900 may be mounted in other orientations, such as in an orientation where one concave flanking surface 930*b* or 930*c* and convex flanking surface 930*a* are sharing on the leading side.

As previously described, the phenomenon by which formation material is removed by the impact of cutting teeth is extremely complex. A variety of factors including, without limitation, the geometry and orientation of the cutting teeth, the design of the rolling cone cutters, and the type of formation being drilled, all play a role in how the formation material is removed and the rate that the material is removed (i.e., ROP). Without being limited to this or any other particular theory, it is believed that pyramid-shaped cutting teeth 800, 900 as described above, may enhance formation removal in certain applications by enhancing the formation of cracks in the uncut formation as compared to a conventional cutting tooth geometries (e.g., tooth 100) of similar size. In particular, it is anticipated that inclusion of concave flanking surfaces 830, 930 offer the potential to enhance crack formation and propagation without the requirement of adding substantial additional weight-on-bit.

Figure 21A:
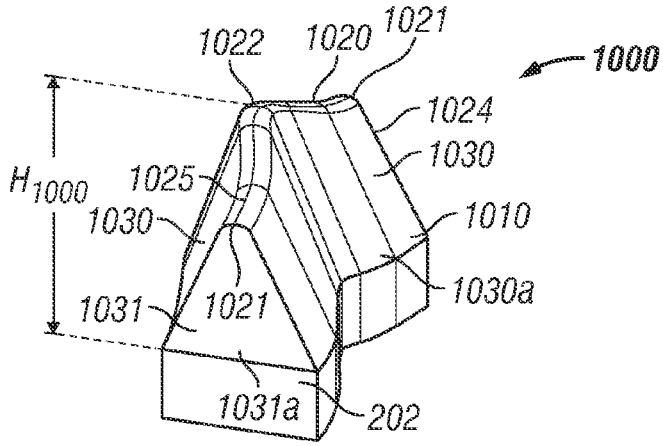
FIG. 21*a* is a perspective view of an embodiment of a cutting tooth having particular application in a rolling cutter bit such as that shown in FIGS. 1 and 2.
Figure 21B:
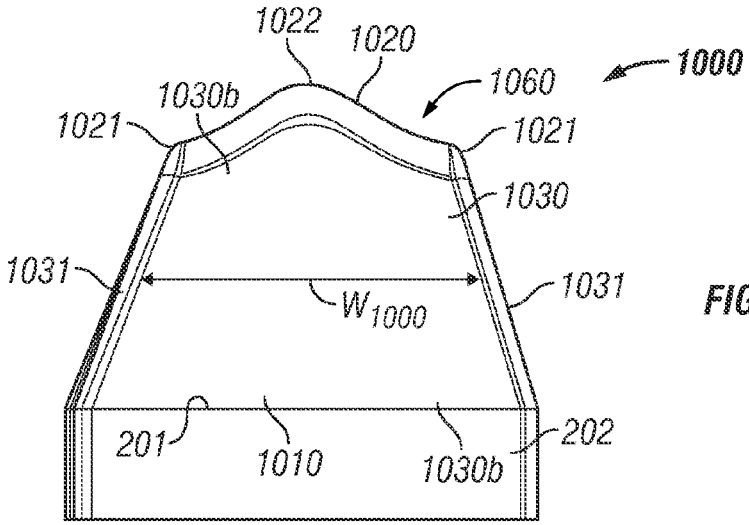
FIG. 21*b* is a side view of the cutting tooth of FIG. 21*a;*
Figure 21C:
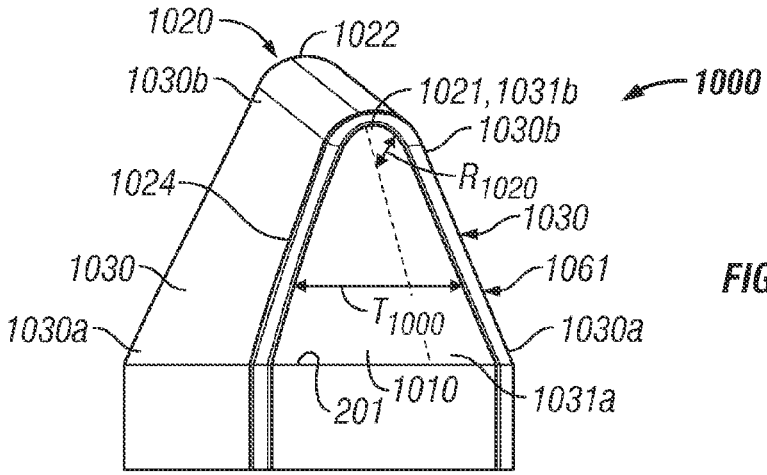
FIG. 21*c* is an end view of the cutting tooth of FIG. 21*a*.

Referring now to FIGS. 21*a*-21*c*, an embodiment of a cutting element or tooth 1000 believed to have particular utility when employed in a rolling cutter tooth bit, such as in gage row 61*a* or inner row 61*b* shown in FIGS. 1-3 above, is shown. However, it should be appreciated that tooth 1000 may also be employed in other rows and other regions on the rolling cone cutter. In FIG. 21, tooth 1000 is shown extending from the surface 201 of a rolling cone cutter 202.

Tooth 1000 has a base 1010 monolithically formed with cutter 202 and an elongate chisel crest 1020 distal base 1010. Crest 1020 extends between crest ends or corners 1021 and comprises an apex 1022 disposed between ends 1021. In this embodiment, crest 1020 extends along a curved crest median line 1025 between crest corners 221. Crest 1020 has a length measured along median line 1025 between crest ends 1021.

Tooth 1000 is generally wedge-shaped, including a pair of flanking surfaces 1030 and a pair of end surfaces 1031. Flanking surfaces 1030 taper or incline towards one another as they extend from base 1010 to crest 1020. In particular, each flanking surface 1030 has a first or base end 1030*a* at base 1010, and a second or crest end 1030*b* that intersects crest 1020. End surfaces 1031 also extend from base 1010 to crest 1020. In particular, end surfaces 1031 extend from base 1010 to crest ends 1021, and generally extend between flanking surfaces 1030. Each end surface 1031 has a first or base end 1031*a* at base 1010, and a second or crest end 1031*b* that intersects crest 1020 at one corner 1021. In this embodiment, end surfaces 1031 are generally planar and parallel, each end surface 1031 extending perpendicularly from cone surface 1001 to one crest end 1021. In other embodiments, the end surfaces (e.g., end surfaces 1031) may taper or incline towards each other as they extend from the base (e.g., base 1020) to the crest (e.g., crest 1020). A continuous edge 1024 extends along the intersection of each end surface 1031 with flanking surfaces 1030 and crest 1020. Although referred to as an "edge," the intersection between end surfaces 1031 with flanking surfaces 1030 and crest 1020 may be radius or rounded. Although end surfaces 1031 are planar in this embodiment, in other embodiments, one or more end surfaces 1031 may be convex or concave.

Unlike tooth 200 previously described, which includes generally planar flanking surfaces 230, in this embodiment, flanking surfaces 1030 are curved. Namely, one flanking surfaces 1030 is concave or inwardly bowed between end surfaces 1031, and the other flanking surface 1030 is convex or outwardly bowed between end surfaces 1031.

In general, tooth 1000 has a height $H_{1000}$ measured perpendicularly from the cone surface to crest 1020 in side view (FIG. 21*b*). Crest 1020 is not parallel to the cone surface 201 in side view, and thus, height $H_{1000}$ varies moving along crest 1020 between ends 1021. In this embodiment, crest 1020 is a maximum at apex 1022, and decreases moving from apex 1022 towards each crest end 1021. In this embodiment, height $H_{1000}$ at each end 1021 is the same, and represents the minimum height $H_{1000}$ of tooth 1000. Further, tooth 1000 has a thickness $T_{1000}$ measured parallel to cone surface 201 between flanking surfaces 1030, and a width $W_{1000}$ measured parallel to cone surface 201 between end surfaces 1031. Since flanking surfaces 1030 are inclined towards each other moving away from base 1010, thickness $T_{1000}$ decreases moving toward crest 1020. Likewise, since end surfaces 1031 are parallel to each other, width $W_{1000}$ is constant between ends 1031*a, b*.

Referring now to the side and end views of FIGS. 21*b* and 21*c*, respectively, end surfaces 1031 and crest 1020 define a side periphery or profile 1060 of tooth 1000 (FIG. 21*b*), while flanking surfaces 1030 and crest 1020 define an end periphery or profile 1061 of tooth 1000 (FIG. 21*c*). As seen in side profile 1060 (FIG. 21*b*), lateral surfaces 1231 are generally straight in the region between base 1010 and crest 1020. Likewise, as seen in end profile 1061 (FIG. 21*c*), flanking surfaces 1030 are generally straight in the region between base 1010 and crest 1020. Consequently, in side and end profiles 1060, 1061, end surfaces 1031 and flanking surfaces 1030, respectively, each have a substantially constant radius of curvature in the region between base 1010 and crest 1020. It is to be understood that a straight line, as well as a flat or planar surface, has a constant radius of curvature of infinity. Although surfaces 1030, 1031 of the embodiment shown in FIGS. 21*a*-21*c* are substantially straight in the region between base 1010 and crest 1020 as illustrated in profiles 1061, 1060, respectively, in other embodiments, the flanking surfaces (e.g., flanking surfaces 1030) and/or the end surfaces (e.g., end surfaces 1031) may be curved or arcuate between the base (e.g., base 1010) and the crest (e.g., crest 1020). Further, as previously described, although flanking surfaces 1030 of the embodiment shown in FIGS. 21*a*-21*c* are substantially straight in the region between base 1010 and crest 1020, one flanking surface 1030 is concave between end surfaces 1031 in top view and the other flanking surface 1031 is convex between end surfaces 1031 in top view.

As previously described, in profiles 1060, 1061, end surfaces 1031 and flanking surfaces 1030, respectively, are substantially straight, each having a constant radius of curvature in the region between base 1010 and crest 1020. The transition from surfaces 1030 to crest 1020 generally occurs where the substantially straight surfaces 1030 begin to curve in profile 1061. In other words, the points in profile 1061 at which the radius of constant curvature of surfaces 1030 begin to change marks the transition into crest 1020.

As shown in FIG. 21*b*, crest 220 is curved in side profile 1060 between crest ends 221. In addition, as shown in FIG. 21*c*, crest 1020 is smoothly curved between flank surface ends 1031*a, b* in end profile 1061. In particular, in end profile view 1061, crest 1020 is convex or bowed outward between ends 1031*a, b* of flanking surfaces 1031 along its entire length, and has a constant radius of curvature $R_{1020}$ between ends 1031*a, b* along its entire length.

Figure 22:
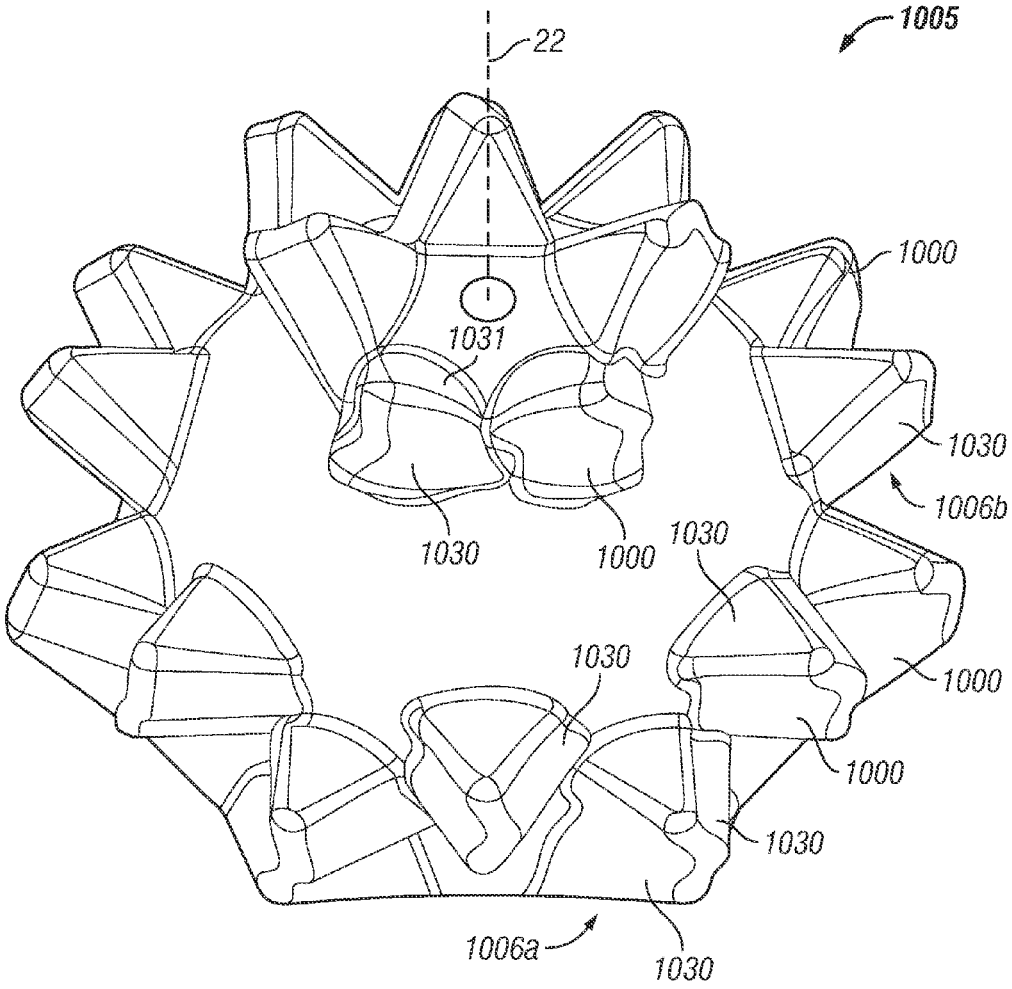
FIG. 22 is a perspective view of a rolling cone cutter having the cutting tooth of FIG. 21*a* mounted therein.

Referring now to FIG. 22, tooth 1000 described above is shown mounted in a rolling cone cutter 1005 as may be employed, for example, in bit 10 described above with reference to FIGS. 1 and 2, with cone cutter 1005 substituted for any of the cones 1-3 previously described. As shown, cone cutter 1005 includes a plurality of teeth 1000 disposed in a circumferential gage row 1006*a* and a plurality of teeth 1000 disposed in a circumferential inner row 1006*b*. In this embodiment, teeth 1000 are all oriented such that concave flanking surface 1030 is on the leading side.

As previously described, the phenomenon by which formation material is removed by the impact of cutting teeth is extremely complex. A variety of factors including, without limitation, the geometry and orientation of the cutting teeth, the design of the rolling cone cutters, and the type of formation being drilled, all play a role in how the formation material is removed and the rate that the material is removed (i.e., ROP). Without being limited to this or any other particular theory, it is believed that scoop-shaped cutting tooth 1000 as described above, may enhance formation removal in certain applications by enhancing the formation of cracks in the uncut formation as compared to a conventional cutting tooth geometries (e.g., tooth 100) of similar size. In particular, it is anticipated that inclusion of concave flanking surfaces 1030 offers the potential to enhance crack formation and propagation without the requirement of adding substantial additional weight-on-bit.

In general, embodiments of cutting teeth disclosed herein (e.g., teeth 200, 300, 400, 500, 600, 700, 800, 900) may be implemented into a roller cone bit using the powder forge cutter (PFC) process. The PFC process enables teeth to be formed in shapes and configurations that may be difficult to be formed by other methods. The PFC process also enables the teeth to be more uniform and have a more consistent alignment as compared to other processes, such as manual placement and welding of individual teeth.

The PFC process can also enable the integration of harder materials, that can be referred to as hardmetal or hardphase, such as tungsten carbide (WC) or Cemented Carbide, in greater amounts. Hardmetal composites can consist of a hardmetal such as tungsten carbide, diamond, cubic boron nitride, or ceramic dispersed in a softer, metal matrix, optionally including a binder metal, to form a hardphase. The hardphase can then be incorporated on the surface of the bit, such as the cone or cutter teeth, to provide a certain thickness that contains the hardmetal. In some embodiments, a hardphase that includes hardmetal in amounts greater than 50% by volume can be integrated into tooth designs utilizing the PFC process wherein the tooth and cutter are forged as a single item. Further, in some embodiments, a hardphase that includes cemented carbide in amounts greater than 50% can be integrated into tooth designs utilizing the PFC process wherein the tooth and cutter are forged as a single item.

Hardmetal is typically applied by welding techniques. The conventional welding application of a hardmetal can limit the hardmetal content, for example to less than about 50% by volume of the hardphase. The forged-in tooth hardmetal of the PFC process can produce cutter teeth having a hardmetal such as cemented carbide in amounts greater than 50% by volume of the hardphase, optionally greater than 70% by volume, optionally greater than 75% by volume. The hardmetal can be integrated into the exterior of the tooth in the PFC process in a hardphase thickness of greater than 0.01 inch. In an embodiment, the hardmetal can be integrated into the exterior of the tooth in the PFC process in a hardphase thickness ranging from 0.01 to 0.50 inch, optionally ranging from 0.01 to 0.25 inch. One process of adding hardmetal that can be utilized with embodiments described herein is disclosed in U.S. patent application Ser. No. 12/536,624 to Sreshta et al. filed on Aug. 6, 2009, which is hereby incorporated herein by reference in its entirety for all purposes.

Although embodiments of cutter cones described herein (e.g., cones 205, 305, 405, 505, 605, 705, 805, 905, 1005) include multiple teeth of a single shape, in general, different embodiments of teeth (e.g., teeth 200, 300, 400, 500, 600, 700, 800, 900) may be included on a single cone to provide a pattern of teeth designs. For example, pyramid-shaped teeth 800, 900 may be desired for the gage rows while scoop-shaped tooth 1000 is preferred for the inner rows. Any combination of the tooth designs of the present application can be incorporated with the other designs or with conventional or alternate tooth designs and are considered to be within the scope of the present application. Further, although embodiments of teeth (e.g., teeth 200, 300, 400, 500, 600, 700, 800, 900, 1000) are described herein as being monolithically formed with the cone cutter 202 from which each extends, in general, similar tooth geometries may be employed in insert cutting elements that are mounted to a cone cutter.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A rolling cone drill bit for cutting a borehole having a borehole sidewall, corner and bottom, the drill bit comprising:

a bit body including a bit axis;

a rolling cone cutter mounted on the bit body and adapted for rotation about a cone axis;

a tooth extending from the cone cutter;

wherein the tooth includes:

a base at the cone cutter and an elongate chisel crest distal the cone cutter, wherein the crest extends along a crest median line between a first crest end and a second crest end and includes an elongate crest apex;

a first flanking surface extending from the base to the crest;

a second flanking surface extending from the base to the crest;

wherein the first flanking surface and the second flanking surface taper towards one another to form the chisel crest;

a first raised rib extending continuously along the first flanking surfaces and across the chisel crest to the second flanking surface;

wherein the crest extends to a height $H_c$ measured perpendicularly from the crest apex to the cone cutter in side view;

wherein the first rib extends from the crest apex to a peak distal the crest;

wherein the peak of the rib is disposed a first rib height $H_{r1}$ measured perpendicularly from the crest apex in side view;

wherein the first rib has a first rib width $W_{r1}$ measured perpendicular to a first rib median line;

wherein the ratio of the first rib height $H_{r1}$ to the first rib width Wr1 at the crest apex is between 0.25 and 0.60.

2. The drill bit of claim 1, wherein the base is monolithically formed with the cone cutter.

3. The drill bit of claim 1, wherein the first raised rib extends along a first rib median line between a first end and a second end, and wherein the first rib median line is oriented perpendicular to the crest median line in side view.

4. The drill bit of claim 3, wherein the first rib end of the first rib is disposed at the base.

5. The drill bit of claim 4, wherein the second rib end of the first rib is disposed at the base.

6. The drill bit of claim 3, wherein the first rib end and the second rib end of the first rib are spaced from the cone cutter.

7. The drill bit of claim 1, wherein the first rib extends from the crest along each flanking surface to the cone cutter.

8. The drill bit of claim 1, wherein the first rib height $H_{r1}$ is between 10% and 15% of the crest height $H_c$.

9. The drill bit of claim 8, wherein the chisel crest has a length $L_c$ measured along the crest median between the first crest end and the second crest end;

wherein the first raised rib extends along the first rib median line between a first rib end and a rib second end;

wherein the first rib comprises a pair of flanking surfaces that extend from the crest to the peak distal the crest;

wherein the flanking surfaces of the first rib taper towards one another to form the peak;

wherein the first rib width $W_{r1}$ is between 15% and 20% of the crest length $L_c$.

10. The drill bit of claim 1, wherein the tooth further includes:

a second raised rib extending continuously along the first flanking surface and across the chisel crest to the second flanking surface.

11. The drill bit of claim 10, wherein the first raised rib extends along the first rib median line between a first end and a second end;

wherein the second raised rib extends along a second rib median line between a first end and a second end; and wherein the second rib median line is oriented parallel to the first rib median line in side view.

12. The drill bit of claim 10, wherein the second rib extends from the crest to a second rib height $H_{r2}$ measured perpendicularly from the crest apex in side view;

wherein the first rib height $H_{r1}$ and the second rib height $H_{r2}$ are each between 10% and 15% of the crest height $H_c$.

13. The drill bit of claim 12, wherein the first rib height $H_{r1}$ is the same as the second rib height $H_{r2}$.

14. The drill bit of claim 1, wherein the cone cutter comprises a plurality of teeth arranged in a circumferential row, each tooth extending from the cone cutter and including:

a base monolithically formed with the cone cutter;

an elongate chisel crest distal the cone cutter and defining an elongate crest apex, wherein the crest extends along a crest median line between a first crest end and a second crest end;

a first flanking surface extending from the base to the crest;

a second flanking surface extending from the base to the crest;

wherein the first flanking surface and the second flanking surface taper towards one another to form the chisel crest extending therebetween;

a first raised rib extending continuously along the first flanking surfaces and across the chisel crest to the second flanking surface.

15. The drill bit of claim 14, wherein the plurality of teeth in the circumferential row are positioned to engage the borehole bottom.

16. The drill bit of claim 2, wherein the tooth is monolithically formed with the cone cutter by a powder forging process.

17. The drill bit of claim 2, wherein the exterior of the tooth comprises at least 50% by volume of hard metal material.

* * * * *